US010937265B2

(12) United States Patent
Yokota et al.

(10) Patent No.: US 10,937,265 B2
(45) Date of Patent: Mar. 2, 2021

(54) COIN-ROLL HANDLING DEVICE AND COIN-ROLL HANDLING METHOD

(71) Applicant: GLORY LTD., Himeji (JP)

(72) Inventors: Yasushi Yokota, Hyogo (JP); Hitoshi Ueno, Hyogo (JP); Youhei Kamada, Hyogo (JP); Mitsunori Yokota, Hyogo (JP); Yoshinori Doi, Hyogo (JP)

(73) Assignee: GLORY LTD., Hyogo (JP)

( * ) Notice: Subject to any disclaimer, the term of this patent is extended or adjusted under 35 U.S.C. 154(b) by 0 days.

(21) Appl. No.: 15/548,135

(22) PCT Filed: Jan. 4, 2016

(86) PCT No.: PCT/JP2016/050049
§ 371 (c)(1),
(2) Date: Aug. 2, 2017

(87) PCT Pub. No.: WO2016/125508
PCT Pub. Date: Aug. 11, 2016

(65) Prior Publication Data

US 2018/0025568 A1 Jan. 25, 2018

(30) Foreign Application Priority Data

Feb. 2, 2015 (JP) ..... JP2015-018759

(51) Int. Cl.
*G07D 5/02* (2006.01)
*G07D 1/00* (2006.01)
*G07D 5/08* (2006.01)

(52) U.S. Cl.
CPC ..... *G07D 5/02* (2013.01); *G07D 1/00* (2013.01); *G07D 5/08* (2013.01)

(58) Field of Classification Search
CPC ..... G01B 5/08; G01B 11/08; G01B 21/10; G07D 7/16; G07D 7/162; G07D 7/164;
(Continued)

(56) References Cited

U.S. PATENT DOCUMENTS 4,650,057 A * 3/1987 Koester ..... G07D 3/16 193/31 A
5,158,166 A * 10/1992 Barson ..... G07D 5/08 194/317
(Continued)

FOREIGN PATENT DOCUMENTS

EP 2159760 A1 * 3/2010 ..... G07D 1/00
JP 3-113472 U 11/1991
(Continued)

OTHER PUBLICATIONS

English Abstract of JP 2012243002 A (Year: 2012).*
(Continued)

*Primary Examiner* — Jeffrey A Shapiro
(74) *Attorney, Agent, or Firm* — Renner, Kenner, Greive, Bobak, Taylor & Weber

(57) ABSTRACT

A coin-roll handling device includes a coin-roll characteristic-value detecting unit 50 configured to detect at least one of a first characteristic value relating to a diameter of a roll of coins being transported by a transporting unit 40 and a second characteristic value relating to a material of the roll of coins being transported by the transporting unit 40, provided downstream of a storage unit 10 in a transportation direction of the roll of coins by the transporting unit 40 and a denomination determining unit 92 configured to determine a denomination of the roll of coins based on at least one of the first characteristic value relating to the diameter of the roll of coins and the second characteristic value relating to the material of the roll of coins detected by the coin-roll characteristic-value detecting unit 50.

20 Claims, 17 Drawing Sheets

(58) Field of Classification Search
CPC .. G07D 5/00; G07D 5/02; G07D 5/08; G07D 11/0045; B65G 2203/0266; B65G 2203/2283; B65G 2203/2291
USPC ..... 702/157; 235/379
See application file for complete search history.

(56) References Cited

U.S. PATENT DOCUMENTS 5,353,906 A 10/1994 Takamisawa et al.
5,381,880 A 1/1995 Pearson
5,386,901 A 2/1995 Ibarrola et al.
5,950,796 A 9/1999 Kobayashi
6,095,369 A * 8/2000 Jenkins ..... G07D 1/00 221/253
6,598,376 B2 * 7/2003 Ohshita ..... G07F 5/24 53/212
6,736,254 B1 * 5/2004 Fortenbery ..... B65G 47/962 198/370.03
7,111,754 B1 * 9/2006 Siemens ..... G07D 1/00 221/200
2002/0005031 A1 * 1/2002 Ohshita ..... G06Q 20/20 53/501
2004/0245067 A1 * 12/2004 Jones ..... G07D 5/02 194/327
2005/0256774 A1 * 11/2005 Clothier ..... G06Q 10/06 705/15
2007/0124021 A1 * 5/2007 Smith ..... G07D 1/00 700/231
2008/0061072 A1 * 3/2008 Sus ..... A47J 37/1228 221/9
2008/0083194 A1 * 4/2008 Kasahara ..... G07D 5/005 53/52
2008/0188169 A1 * 8/2008 Sakai ..... G07D 1/06 453/3
2008/0265019 A1 * 10/2008 Artino ..... G06Q 20/1085 235/379
2009/0166227 A1 * 7/2009 Imai ..... G07D 1/02 206/0.81
2009/0205926 A1 8/2009 Piccirillo et al.
2010/0121485 A1 * 5/2010 Hosoda ..... G07D 9/065 700/223
2011/0295741 A1 * 12/2011 Sugitani ..... G07D 11/50 705/39
2012/0012437 A1 * 1/2012 Matsumoto ..... G07D 9/00 194/342
2012/0301009 A1 * 11/2012 Dabic ..... G07D 5/005 382/136
2014/0096405 A1 * 4/2014 Lee ..... G01B 21/10 33/502

FOREIGN PATENT DOCUMENTS

JP 5-20523 A 1/1993
JP 7-105426 A 4/1995
JP 8-263720 A 10/1996
JP 11-185101 A 7/1999
JP 3328819 B2 9/2002
JP 2002-329227 A 11/2002
JP 3456851 B2 10/2003
JP 3-113472 U 9/2005
JP 2010066939 A * 3/2010 ..... G07D 1/00
JP 2010-231469 A 10/2010
JP 2011-248570 A 12/2011
JP 2012243002 A * 12/2012 ..... G07D 1/00
JP 2013-12177 A 1/2013
JP 2013-61822 A 4/2013
JP 5934793 B2 * 6/2016 ..... B65B 57/18

OTHER PUBLICATIONS

Machine Translation of JP 2012243002 A from JPLAT-Pat (Year: 2020).*
English Abstract of JP 2010066939 A (Year: 2010).*
Machine Translation of JP 2010066939 A from JPLAT-Pat (Year: 2020).*
English Machine Translation of JP 5934793 B2 (Year: 2016).*
Written Opinion of the International Searching Authority (International Application No. PCT/JP2016/050049) (15 pages—dated Feb. 16, 2016).
European Search Report (Application No. 16746339.7—PCT/JP2016/050049) (20 pages—dated Nov. 10, 2018).

* cited by examiner

COIN-ROLL HANDLING DEVICE AND COIN-ROLL HANDLING METHOD

TECHNICAL FIELD

The present invention relates to a coin-roll handling device for handling a roll of coins and a coin-roll handling method implemented by the coin-roll handling device.

DESCRIPTION OF THE RELATED ART

Various types of coin-roll ejecting devices, each including a plurality of storage units capable of storing therein a plurality of rolls of coins and having an ejecting mechanism for ejecting the roll of coins stored in the storage units, are known in the art. In such a coin-roll ejecting device, as a method of checking the denomination and the quantity of rolls of coins stored in each storage unit, a method of detecting a diameter of the roll of coins or the presence or absence of a center hole in the roll of coins stored in each storage unit by a photo-interrupter is used (for example, see Japanese Patent No. 3456851 (JP3456851B)). However, in the coin-roll ejecting device disclosed in Japanese Patent No. 3456851, it is necessary to install a plurality of photo-interrupters, one for each of the storage units. There has been a problem in that the structure of such a coin-roll ejecting device provided with a plurality of photo-interrupters becomes complicated and the cost becomes high. In addition, the coin-roll ejecting device disclosed in Japanese Patent No. 3456851 has a problem in that the roll of coins can be stored in only one row in each storage unit, and then the storage volume becomes insufficient. Additionally, it is difficult to detect the denomination and the quantity of rolls of coins stored in each storage unit by the photo-interrupter when a plurality of rolls of coins are stored in each storage unit, stacked in several layers.

By contrast, Japanese Utility Model Laid-Open Publication No. H3-113472 (JP3-113472U) discloses a method of discriminating the denomination and the quantity of rolls of coins fed out from a storage unit by a feeding mechanism. Specifically, Japanese Utility Model Laid-Open Publication No. H3-113472 discloses a method in which the roll of coins fed out from the storage unit is transported by an endless belt with a protruding member, and the roll of coins is brought into contact with a detecting lever. The detecting lever is displaceable by an amount that corresponds to the diameter of the roll of coins. According to the coin-roll ejecting device disclosed in Japanese Utility Model Laid-Open Publication No. H3-113472, after amplifying the displacement of the detecting lever, this displacement is directly transmitted to an encoder installed at another location. The number of pulses of the encoder is then measured, and if the measured number of pulses of the encoder is different from a pre-set number of pulses corresponding to a given denomination, the roll of coins is rejected without being sent to the ejecting opening.

In addition, Japanese Patent Laid-Open Publication No. 2013-061822 (JP2013-061822A) discloses a coin-roll handling device that transports the roll of coins fed out from a storage unit by a feeding mechanism using an endless belt with protruding members. An insertion opening is formed so as to face an ejecting opening in a guiding member of a transport path. A switching plate for closing the insertion opening is arranged so as to be pivotable with its upper end acting as a fulcrum. Furthermore, the coin-roll handling device disclosed in Japanese Patent Laid-Open Publication No. 2013-061822 has a denomination determining unit for determining a denomination of the roll of coins sent out from a batch storage unit. This denomination determining unit determines the denomination of the roll of coins by detecting a rocking angle of the switching plate that pivots according to the diameter of the roll of coins passing through the denomination determining unit, for example.

SUMMARY OF INVENTION

In the coin-roll ejecting device disclosed in Japanese Utility Model Application Laid-Open Publication No. H3-113472, the detecting lever is brought into contact with the roll of coins transported by the endless belt and the displacement of the detecting lever corresponding to the diameter of the roll of coins is detected. Then, the diameter of the roll of coins is detected by directly transmitting the displacement of the detecting lever to the encoder. In this case, it is not easy to assemble a detection system such as a detecting lever, an encoder and the like inside the housing of the coin-roll ejecting device, and there is a problem in that the component cost of the detection system is high. Furthermore, in the coin-roll ejecting device disclosed in Japanese Patent Laid-Open Publication No. 2013-061822, the denomination of the roll of coins is determined based on the pivot angle of the switching plate, but the method of detecting the pivot angle of the switching plate is unclear.

Further, in the coin-roll ejecting device disclosed in Japanese Utility Model Laid-Open Publication No. H3-113472 and Japanese Patent Laid-Open Publication No. 2013-061822, the denomination of the roll of coins is determined by detecting the diameter of the roll of coins. However, regarding coins issued by countries and regions other than Japan, the size of the diameter of the coin may be similar even for different denominations, and it is consequently difficult to determine the denomination of the roll of coins issued by such countries or regions by referring only to the diameter of the roll of coins.

The present invention was made in view of the above discussion. An object of the present invention is to provide a coin-roll handling device and a coin-roll handling method that can quickly and reliably determine the denomination of the roll of coins.

A coin-roll handling device of the present invention includes: a storage unit capable of storing a plurality of rolls of coins and provided with an ejecting mechanism for ejecting the stored rolls of coins; a transporting unit configured to transport the roll of coins ejected from the storage unit by the ejecting mechanism; a coin-roll characteristic-value detecting unit configured to detect at least one of a first characteristic value relating to a diameter of the roll of coins being transported by the transporting unit and a second characteristic value relating to a material of the roll of coins being transported by the transporting unit, provided downstream of the storage unit in a transportation direction of the roll of coins; and a denomination determining unit configured to determine a denomination of the roll of coins based on at least one of the first characteristic value relating to the diameter of the roll of coins and the second characteristic value relating to the material of the roll of coins detected by the coin-roll characteristic-value detecting unit.

The coin-roll handling device of the present invention may further include: an ejecting unit configured to eject the roll of coins from the inside to the outside of a housing; a rejecting unit; and a diverting unit configured to divert the roll of coins being transported by the transporting unit to either the ejecting unit or the rejecting unit, and the roll of coins may be diverted to the ejecting unit from the transporting unit by the diverting unit if the denomination of the roll of coins is determined by the denomination determining unit as being the denomination of the roll of coins to be ejected from the inside to the outside of the housing, and the roll of coins may be diverted to the rejecting unit from the transporting unit by the diverting unit if the denomination of the roll of coins is determined by the denomination determining unit as not being the denomination of the roll of coins to be ejected from the inside to the outside of the housing.

In the coin-roll handling device of the present invention, the coin-roll characteristic-value detecting unit may include a first characteristic-value detecting portion that detects the first characteristic value relating to the diameter of the roll of coins being transported by the transporting unit and a second characteristic-value detecting portion that detects the second characteristic value relating to the material of the roll of coins being transported by the transporting unit, and the denomination determining unit may determine the denomination of the roll of coins based on both the first characteristic value relating to the diameter of the roll of coins detected by the first characteristic-value detecting portion and the second characteristic value relating to the material of the roll of coins detected by the second characteristic-value detecting portion.

In this case, the first characteristic-value detecting portion may include a detecting lever that is capable of contacting the roll of coins being transported by the transporting unit and is rotatable about a shaft, a magnet that rotates integrally with the detecting lever, and an angle sensor that detects a rotational angle of the detecting lever when the roll of coins being transported by the transporting unit comes into contact with the detecting lever, the angle sensor detecting the rotational angle of the detecting lever based on the change of the magnetic field caused by the rotation of the magnet, and the first characteristic-value detecting portion may detect the first characteristic value relating to the diameter of the roll of coins being transported by the transporting unit based on the rotational angle of the detecting lever.

Further, the coin-roll characteristic-value detecting unit may further include a temperature sensor, and the first characteristic-value detecting portion may detect the first characteristic value relating to the diameter of the roll of coins being transported by the transporting unit based on a corrected value that is obtained by correcting the rotational angle of the detecting lever detected by the angle sensor based on a temperature detected by the temperature sensor.

Further, at least a part of the detecting lever may be made of resin.

Further, the transporting unit may include a linearly extending transporting member and the roll of coins may be transported along a direction in which the transporting member extends, and the first characteristic-value detecting portion may be disposed in a region on the same side as the roll of coins being transported by the transporting unit with respect to the transporting member.

Further, the second characteristic-value detecting portion may include a circuit including at least a coil and a capacitor and a sensor for detecting an impedance characteristic and an inductance characteristic of the circuit, and a magnetic field may be generated in the vicinity of the circuit by an alternating current flowing through the coil of the circuit, and the second characteristic-value detecting portion may detect the second characteristic value based on changes in the impedance characteristic and the inductance characteristic of the circuit when the roll of coins being transported by the transporting unit passes through the vicinity of the circuit.

In this case, the transporting unit may include a linearly extending transporting member and the roll of coins may be transported along a direction in which the transporting member extends, and the second characteristic-value detecting portion may be disposed in a region on the opposite side to the roll of coins being transported by the transporting unit with respect to the transporting member.

Further, the coin-roll characteristic-value detecting unit may further include a temperature sensor, and the second characteristic-value detecting portion may detect the second characteristic value relating to the material of the roll of coins being transported by the transporting unit based on a corrected value that is obtained by correcting the amount of changes in the impedance characteristic and the inductance characteristic of the circuit based on a temperature detected by the temperature sensor.

In the coin-roll handling device of the present invention, the transporting unit may include a plurality of endless belts arranged in parallel and each of which has a plurality of protruding members on which the roll of coins is hooked, and in each of the endless belts, each of the protruding members may be formed to project outwardly such that a surface of the protruding member contacting the roll of coins extends in a direction inclined with respect to a direction in which the endless belt extends, and the roll of coins hooked on the protruding member may be shifted toward the endless belt on the protruding member by a weight of the roll of coins.

In this case, in each of the endless belts, the protruding members of the endless belts may be arranged in a same phase in a movement direction of the endless belt.

Further, the coin-roll handling device of the present invention may further includes a coin-roll detecting sensor for detecting the roll of coins ejected from the storage unit by the ejecting mechanism, and the coin-roll detecting sensor may be also capable of detecting each of the protruding members of the transporting unit.

In the coin-roll handling device of the present invention, a first shutter capable of being opened and closed may be provided between the transporting unit and the ejecting unit, and the roll of coins may be sent from the transporting unit to the ejecting unit when the first shutter is opened.

Further, the rejecting unit may be provided with a full-state detection sensor that detects when the rejecting unit becomes full with or almost full with the roll of coins.

Further, the ejecting unit may be provided with a second shutter that selectively enables access to the roll of coins sent from the transporting unit to the ejecting unit, and opening the second shutter enables access to the roll of coins in the ejecting unit.

In the coin-roll handling device of the present invention, a coin receiving unit that receives a coin dropped from the transporting unit by a weight of the coin may be provided below the transporting unit.

In the coin-roll handling device of the present invention, the storage unit, the transporting unit and the coin-roll characteristic-value detecting unit may be provided inside a safe that only a person with predetermined authority has access thereto.

A coin-roll handling device of the present invention includes: a transporting unit configured to transport a roll of coins in a housing; a coin-roll characteristic-value detecting unit configured to detect at least one of a first characteristic value relating to a diameter of the roll of coins being transported by the transporting unit and a second characteristic value relating to a material of the roll of coins being transported by the transporting unit; and a denomination determining unit configured to determine a denomination of the roll of coins based on at least one of the first characteristic value relating to the diameter of the roll of coins and the second characteristic value relating to the material of the roll of coins detected by the coin-roll characteristic-value detecting unit.

A coin-roll handling method of the present invention includes: ejecting a roll of coins from a storage unit capable of storing a plurality of rolls of coins; transporting the roll of coins ejected from the storage unit; detecting at least one of a first characteristic value relating to a diameter of the roll of coins being transported and a second characteristic value relating to a material of the roll of coins being transported; and determining a denomination of the roll of coins based on at least one of the detected first characteristic value relating to the diameter of the roll of coins and the detected second characteristic value relating to the material of the roll of coins.

A coin-roll handling method of the present invention includes: transporting a roll of coins; detecting at least one of a first characteristic value relating to a diameter of the roll of coins being transported and a second characteristic value relating to a material of the roll of coins being transported; and determining a denomination of the roll of coins based on at least one of the detected first characteristic value relating to the diameter of the roll of coins and the detected second characteristic value relating to the material of the roll of coins.

BRIEF DESCRIPTION OF THE DRAWINGS

FIG. 3 is a side view depicting an outline of the internal configuration of the coin-roll handling device shown in FIG. 1 and the like.

FIG. 5 is a perspective view of a configuration of an ejecting unit of the coin-roll handling device shown in FIG. 1 and the like.

FIG. 6 is a side view schematically showing another configuration example of a coin-roll characteristic-value detecting unit provided in the coin-roll handling device shown in FIG. 1 and the like.

FIG. 7 is a side view showing an example of a configuration of a sensor for detecting a first characteristic value relating to a diameter of a roll of coins in the coin-roll characteristic-value detecting unit provided in the coin-roll handling device shown in FIG. 1 and the like.

FIG. 8 is a side view showing another example of a configuration of a sensor for detecting the first characteristic value relating to the diameter of the roll of coins in the coin-roll characteristic-value detecting unit provided in the coin-roll handling device shown in FIG. 1 and the like.

FIG. 10 is a side view showing still another example of a configuration of a sensor for detecting the first characteristic value relating to the diameter of the roll of coins in the coin-roll characteristic-value detecting unit provided in the coin-roll handling device shown in FIG. 1 and the like.

DETAILED DESCRIPTION OF THE INVENTION

Figure 1:
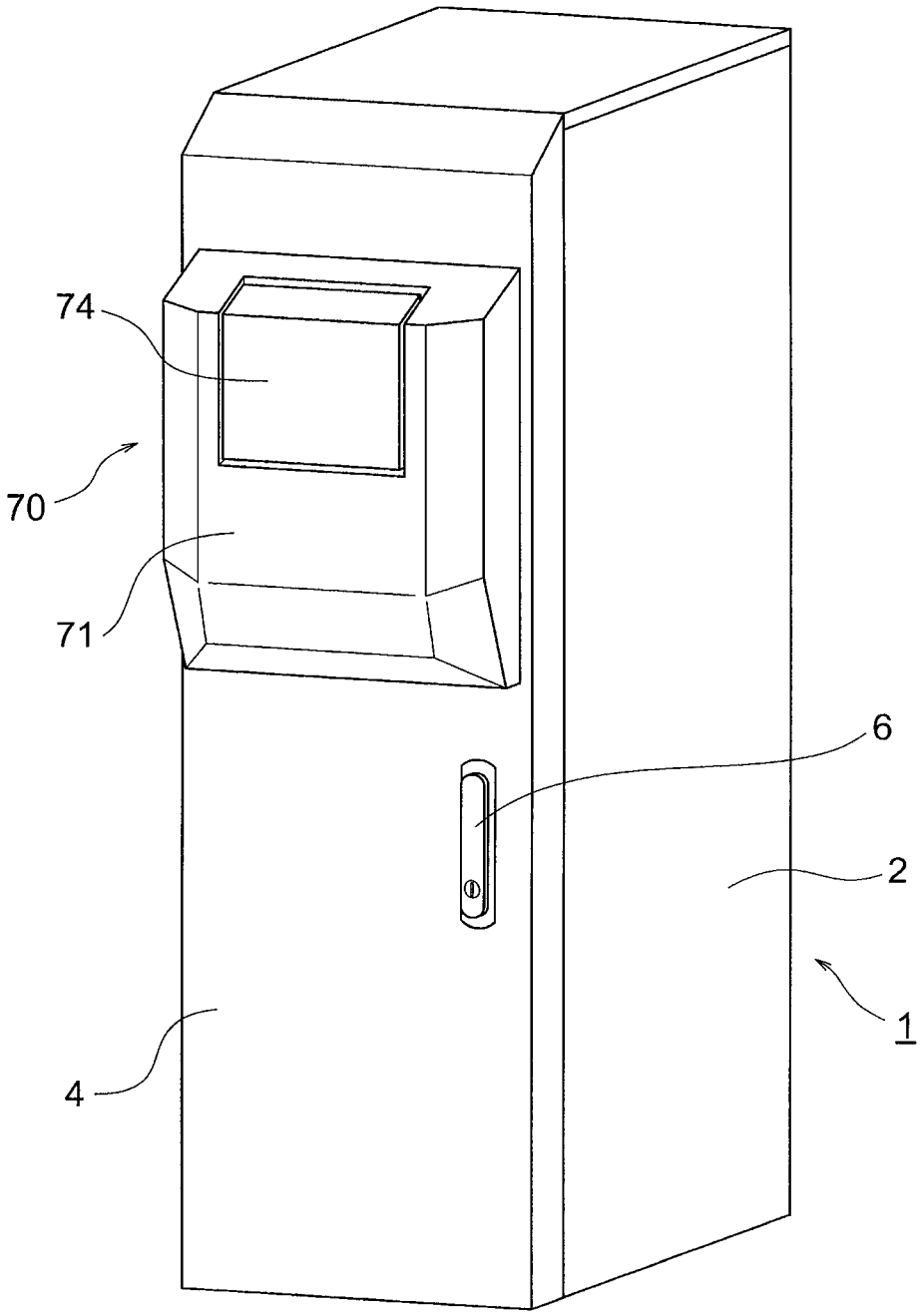
FIG. 1 is a perspective view of an appearance of a coin-roll handling device according to an embodiment of the present invention.
Figure 2:
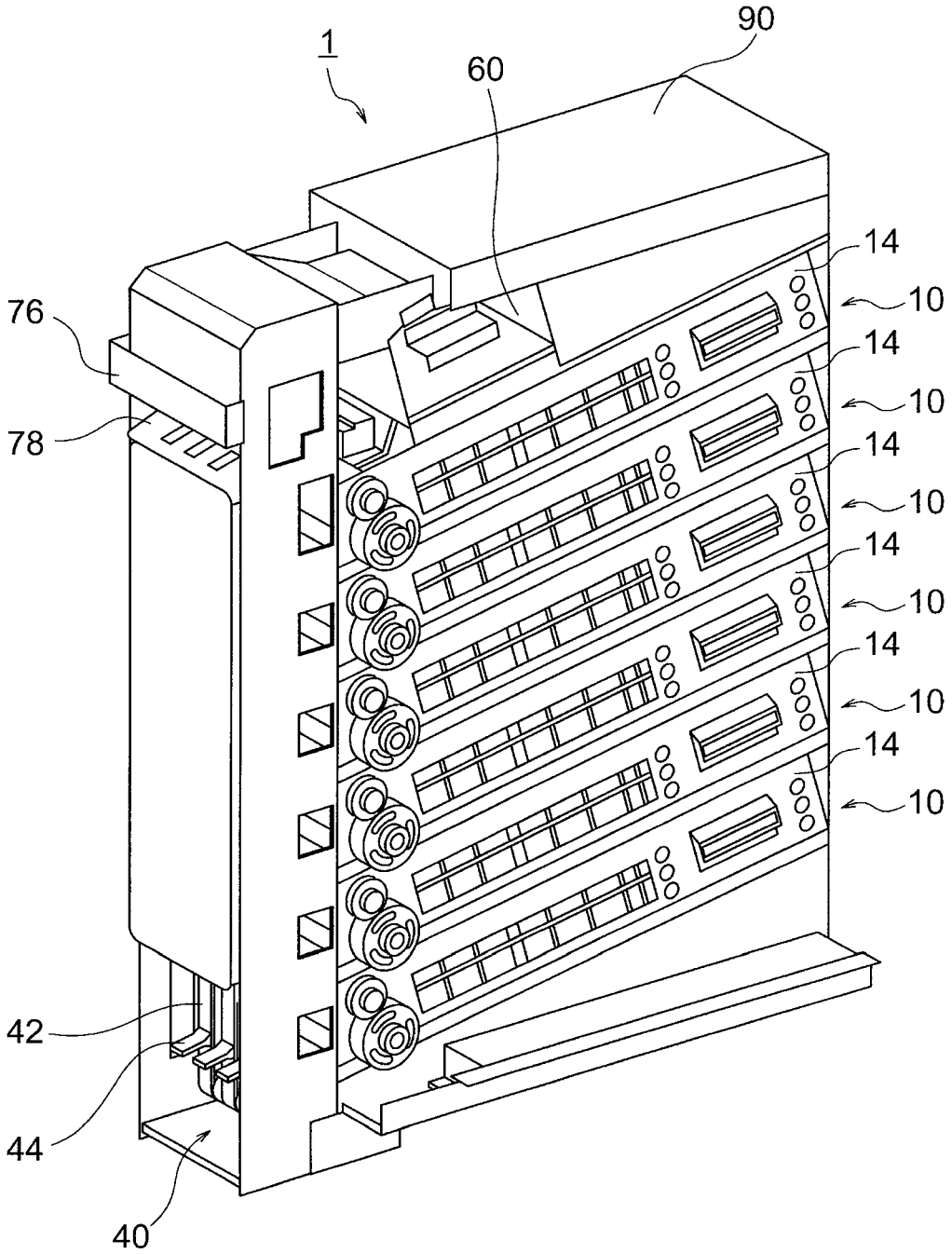
FIG. 2 is a perspective view of an internal configuration of the coin-roll handling device shown in FIG. 1.
Figure 3:
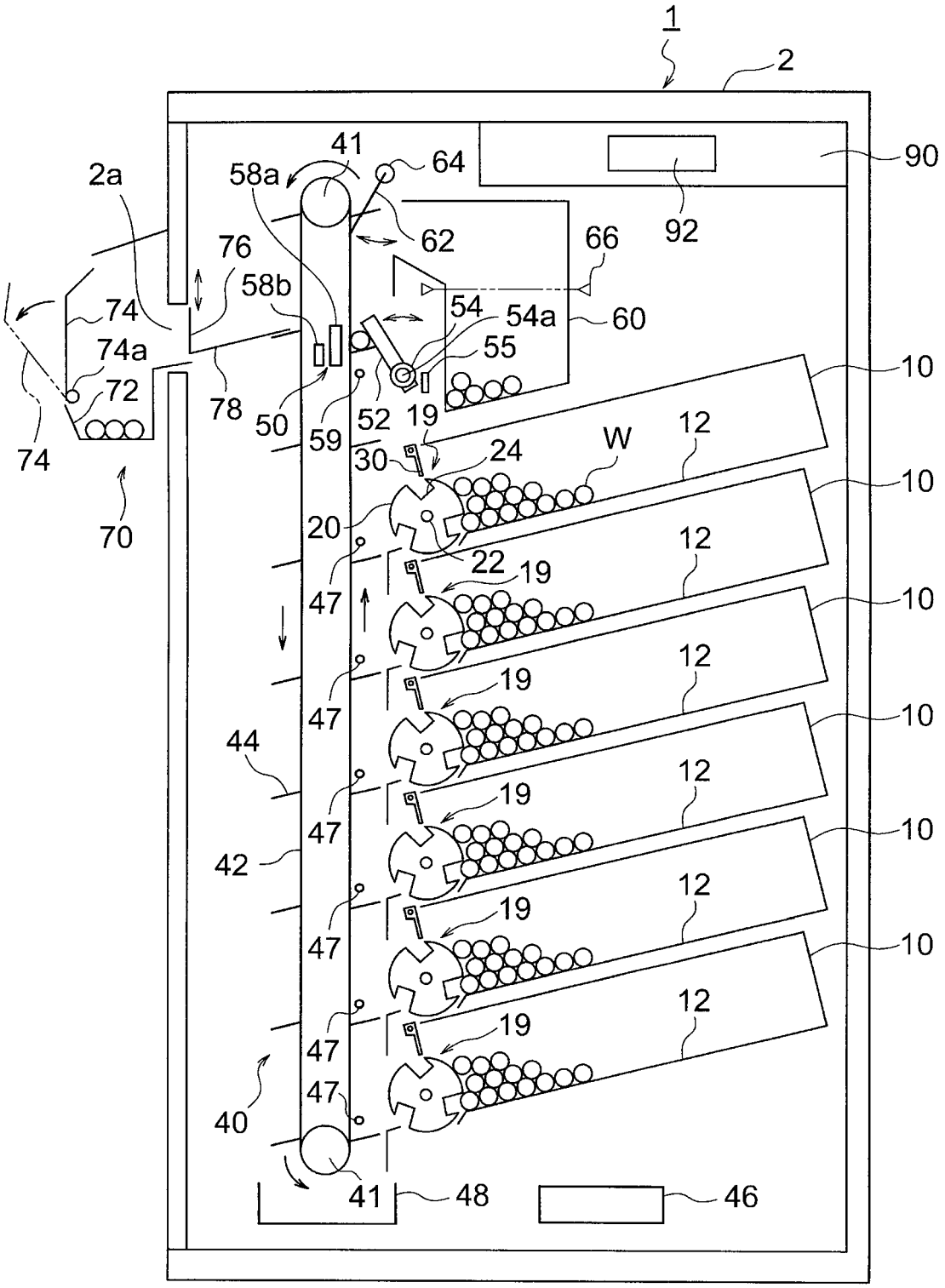
Figure 4:
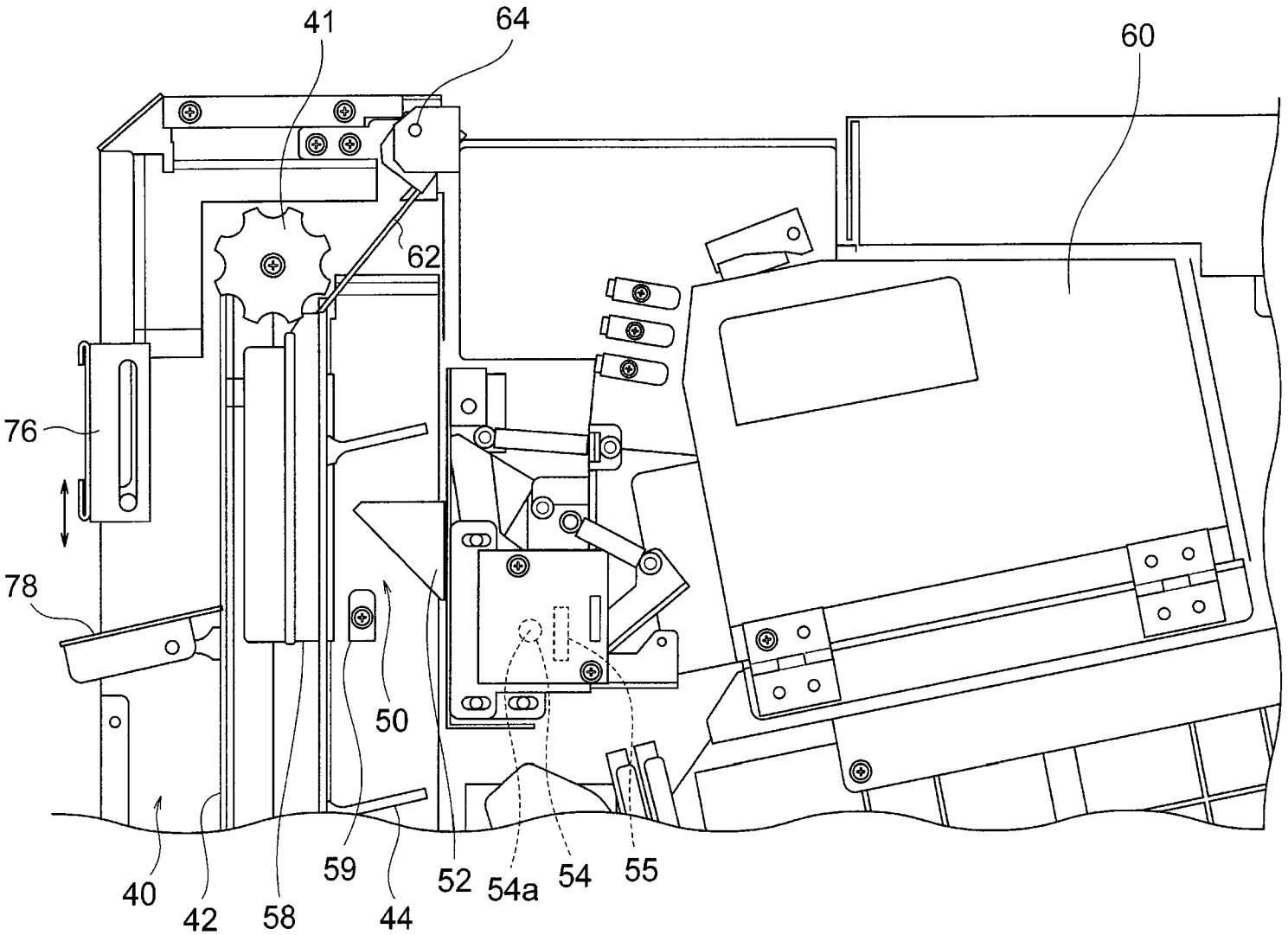
FIG. 4 is an enlarged side view depicting details of an upper part of the internal configuration of the coin-roll handling device shown in FIG. 3.
Figure 5:
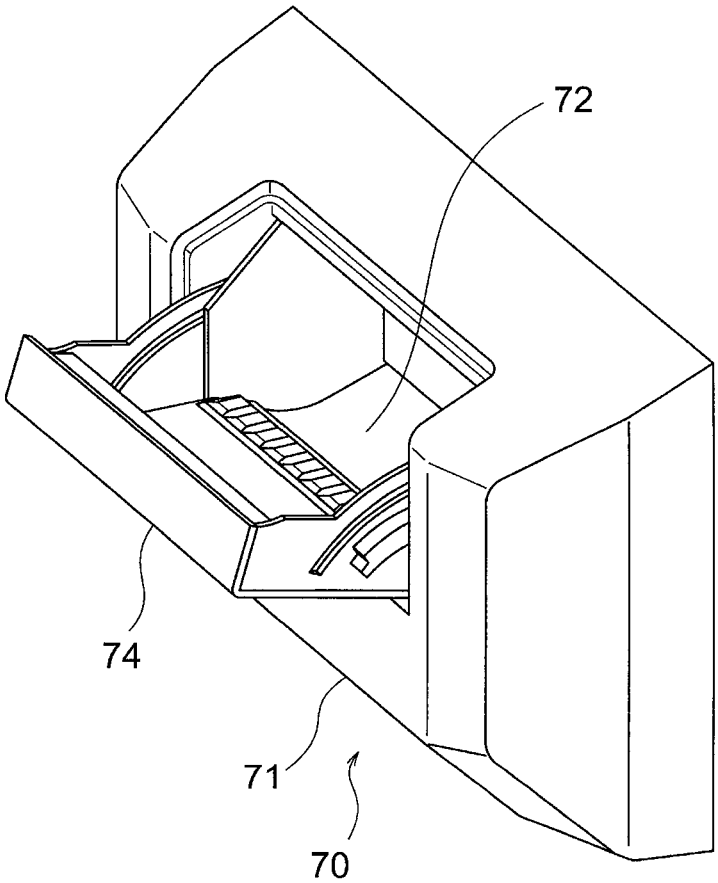

Exemplary embodiments of the present invention are explained below with reference to the accompanying drawings. FIGS. 1 to 5 depict a coin-roll handling device according to one embodiment of the present invention. FIG. 1 is a perspective view of an appearance of the coin-roll handling device according to the present embodiment. FIG. 2 is a perspective view of an internal configuration of the coin-roll handling device shown in FIG. 1. FIG. 3 is a side view depicting an outline of the internal configuration of the coin-roll handling device shown in FIG. 1 and the like. FIG. 4 is an enlarged side view depicting details of an upper part of the internal configuration of the coin-roll handling device shown in FIG. 3. FIG. 5 is a perspective view of a configuration of an ejecting unit of the coin-roll handling device shown in FIG. 1 and the like.

The coin-roll handling device according to the present embodiment has a configuration to store a plurality of rolls of coins per denomination inside a body thereof and to eject the stored roll of coins outside of the body. As shown in FIGS. 1 to 3, a coin-roll handling device 1 according to the present embodiment includes a housing 2 having a substantially rectangular shape and a plurality of storage units 10 (e.g., six) arranged in the housing 2 one above another along a vertical direction. Each of the storage units 10 includes a bottom surface 12 (see FIG. 3) that supports the stored roll of coins, and an ejecting mechanism 19 that ejects the roll of coins one by one from a side of the bottom surface 12 that is at a lower level with respect to the vertical direction. Moreover, the coin-roll handling device 1 according to the present embodiment includes a transporting unit 40 that sequentially transports the roll of coins that is fed out from the storage unit 10 by the ejecting mechanism 19, an ejecting unit 70 that ejects the roll of coins transported by the transporting unit 40 from the inside to the outside of the housing 2, and a rejecting unit 60 that stores therein rolls of coins that should not be ejected out of the housing 2. A controlling unit 90 that controls various components of the coin-roll handling device 1 is installed in the housing 2 of the coin-roll handling device 1. A detailed explanation is given below about the various components of the coin-roll handling device 1.

As shown in FIG. 3, in each of the storage units 10, the roll of coins is stored on the bottom surface 12 in a piled-up manner. A plurality of rolls of coins accumulates at the low-level side of the bottom surface 12. The rolls of coins roll in this direction (i.e., a lower left direction in FIG. 3) because the bottom surface 12 is inclined with respect to a horizontal plane. The term "to store a plurality of rolls of coins in a piled-up manner" includes, depending on the number of rolls of coins stored in the storage unit 10, a situation where a plurality of rolls of coins is piled-up in several layers on the bottom surface 12, a situation where a plurality of rolls of coins is lined-up in one layer (one row) on the bottom surface 12, or a situation where there is only one roll of coins. Moreover, a plurality of rolls of coins may be stored in an orderly and properly aligned manner, or a plurality of rolls of coins may be stored in a non-orderly manner although their directions may be aligned. That is, although a plurality of rolls of coins can be piled-up in several layers, it is not necessary that a plurality of rolls of coins is piled-up in several layers, and it is not necessary that a plurality of rolls of coins is properly aligned.

An angle of inclination of the bottom surface 12 of each of the storage units 10 with respect to the horizontal plane is within the range of 8 degrees to 20 degrees. Moreover, the maximum static friction coefficient of the bottom surface 12 of each of the storage units 10 with respect to the roll of coins is within the range of 0.01 to 0.15. As a result, the roll of coins that is in contact with the bottom surface 12 stored in each of the storage units 10 slide or roll under their weight along the inclined bottom surface 12 towards the ejecting mechanism 19 without being stopped by friction.

Each of the storage units 10 includes a pair of side walls that constitutes a storing area therebetween for the roll of coins. At least one of the side walls constitutes a door 14 (see FIG. 2) that is opened/closed when replenishing the roll of coins in the storage unit 10 or taking out the roll of coins from the storage unit 10. The side wall of the storage unit 10 that constitutes the door 14 is made from a transparent member or a semi-transparent member, for example, so that the operator can see inside the storage unit 10 through this side wall. Instead of making the door 14 with the transparent member or the semi-transparent member, the door 14 can be provided with a slit, a hole, and the like, to allow the operator to see inside the storage unit 10.

As explained earlier, each of the storage units 10 includes the ejecting mechanism 19 that ejects the roll of coins one by one from an end of the bottom surface 12 that is at a lower level with respect to the vertical direction. Detailed explanation about a configuration of the ejecting mechanism 19 is given below with reference to FIG. 3. Each of the ejecting mechanisms 19 includes a rotatable member 20 that is arranged to be rotatable in the counterclockwise direction in FIG. 3 about a rotational axis 22 provided as a shaft center extending horizontally but orthogonally to the direction of inclination of the storage unit 10 (i.e., extends orthogonally to the paper sheet of FIG. 3). Each of the rotatable members 20 is provided with at least two notches 24 (three notches are shown in the example shown in FIG. 3 and the like). One notch 24 receives one roll of coins stored in the storage unit 10. A gate member 30 is arranged above the rotatable member 20 in the ejecting mechanism 19. This gate member 30 prevents a situation where the roll of coins stored in the storage unit 10 does not enter into each notch 24 of the rotatable member 20 whereby it is ejected from above the rotatable member 20. That is, as shown in FIG. 3, by blocking a gap between a top surface of the storage unit 10 and the rotatable member 20 using the gate member 30, when a large number of rolls of coins have been stored in the storage unit 10, it is prevented that the roll of coins is ejected on the transporting unit 40 side from this gap between the top surface of the storage unit 10 and the rotatable member 20.

In the present embodiment, the roll of coins of which denomination should be stored in which of the storage unit 10 is pre-set. When making this setting, it is possible to set the rolls of coins of the same denomination are stored in a plurality of storage units 10.

As shown in FIG. 3, the transporting unit 40 is arranged inside the housing 2 nearer to the front side (i.e., on the left of the storage units 10 in FIG. 3) than the storage units 10. The roll of coins ejected by the ejecting mechanism 19 from each of the storage units 10 is transported one by one by the transporting unit 40. The transporting unit 40 includes two pulleys 41, an endless belt 42, and a driving motor 46. One pulley 41 is arranged in the upper part of the housing 2 and the other pulley 41 is arranged in the lower part. The endless belt 42 is stretched over these two pulleys 41. The driving motor 46 rotationally drives one of the pulleys 41 (specifically, the pulley 41 arranged in the lower part in FIG. 3) to rotate the endless belt 42 to perform a cyclic shift in the counterclockwise direction in FIG. 3. As shown in FIG. 3, the endless belt 42 is provided with a plurality of protruding members 44. The roll of coins fed out from the storage units 10 by the ejecting mechanism 19 is hooked on those protruding members 44. The protruding members 44 project out from the endless belt 42 in an inclined manner. That is, the surface of the protruding member 44 that contacts the roll of coins makes a predetermined angle (e.g., within the range of 45 degrees to 80 degrees, and preferably, for example, 60 degrees) with respect to a direction in which the endless belt 42 extends (i.e., the vertical direction in FIG. 3). Because the protruding members 44 are inclined with respect to the direction in which the endless belt 42 extends, the roll of coins hooked on the protruding members 44 is shifted toward the endless belt 42 on the protruding members 44 under its own weight. When the endless belt 42 makes the cyclic shift in the counterclockwise direction in FIG. 3, by the movement of the endless belt 42, the roll of coins that is fed out from the storage units 10 by the ejecting mechanism 19 is transported along a direction shown with a straight arrow in FIG. 3 in a state of being hooked on the protruding members 44 (i.e., shifted on the protruding member 44 toward the endless belt 42). In the present embodiment, the endless belt 42 is driven by the driving motor 46 to perform intermittent shifts. That is, the endless belt 42 is shifted by a predetermined distance and stopped for a predetermined time, and this operation is repeated.

Only one endless belt 42 is shown in FIG. 3; however, in reality, three endless belts 42 are arranged parallel to but separated from each other. The protruding members 44 of all the endless belts 42 are arranged at the same phase in a direction of shift of the endless belts 42 (see FIG. 2). That is, the roll of coins fed out from the storage unit 10 by the ejecting mechanism 19 is hooked on three corresponding protruding members 44 of all the three endless belts 42.

As shown in FIG. 3, the transporting unit 40 includes a sensor 47, including a photo-interrupter and the like, one for each of the storage units 10. The sensors 47 detect the roll of coins fed out from the storage units 10 by the ejecting mechanism 19. When the roll of coins is fed out from the storage unit 10 by the ejecting mechanism 19, this roll of coins can be detected by the sensor 47. As shown in FIG. 3, the sensors 47 are arranged in a region in which the protruding members 44 of the endless belt 42 shift. Accordingly, the sensors 47 can also detect the protruding members 44 of the endless belt 42. With this arrangement, each sensor 47 can detect a situation where, when the endless belt 42 is making the cyclic shift in the counterclockwise direction in FIG. 3, the endless belt 42 cannot make the cyclic shift at a predetermined speed because of jamming of the roll of coins and the like.

As shown in FIG. 3, a coin receiving unit 48, including a tray and the like, is arranged below the transporting unit 40. When the endless belt 42 makes the cyclic shift in the counterclockwise direction in FIG. 3 while the protruding members 44 have hooked the roll of coins, there may be a situation where the packaging paper of the roll of coins is torn and some coins become loose and fall down under their own weight. When this happens, the falling loose coins are received in the coin receiving unit 48. With this arrangement, when the packaging paper of the roll of coins is torn and the coins fall down under their own weight when the roll of coins is transported by the endless belt 42, scattering of such coins inside the housing 2 can be prevented.

In the present embodiment, as shown in FIG. 3, a coin-roll characteristic-value detecting unit 50 is arranged in the housing 2. The coin-roll characteristic-value detecting unit 50 detects a first characteristic value relating to a diameter of the roll of coins being transported by the transporting unit 40 and a second characteristic value relating to a material of the roll of coins being transported by the transporting unit 40. The coin-roll characteristic-value detecting unit 50 is arranged downstream of each storage unit 10 with respect to a transportation direction of the roll of coins when transported by the transporting unit 40. The coin-roll characteristic-value detecting unit 50 detects the first characteristic value relating to the diameter of the roll of coins and the second characteristic value relating to the material of the roll of coins fed out from the storage units 10 by the ejecting mechanism 19. A detailed explanation about a configuration of the coin-roll characteristic-value detecting unit 50 is given below with reference to FIGS. 3 and 4.

As shown in FIGS. 3 and 4, the coin-roll characteristic-value detecting unit 50 includes a detecting lever 52, a magnet 54*a*, and an angle sensor 55. The detecting lever 52 is rotatable about a shaft 54 and is capable of contacting the roll of coins being transported by the transporting unit 40. The magnet 54*a* is arranged on the shaft 54 and is capable of rotating integrally with the detecting lever 52. The angle sensor 55 detects a rotational angle of the detecting lever 52 at an instant when the roll of coins being transported by the transporting unit 40 contacts the detecting lever 52. The angle sensor 55 detects the rotational angle of the detecting lever 52 based on a change in the magnetic field occurring because of the rotation of the magnet 54*a*. The first characteristic value relating to the diameter of the roll of coins being transported by the transporting unit 40 is detected based on the rotational angle of the detecting lever 52. In the present embodiment, a first characteristic-value detecting portion for detecting the first characteristic value relating to the diameter of roll of coins being transported by the transporting unit 40 is constituted by the detecting lever 52, the shaft 54, the magnet 54*a*, and the angle sensor 55. Hereinafter, details of each constituent member in such a first characteristic-value detecting portion will be described.

As shown in FIGS. 3 and 4, the detecting lever 52 rotatable about the shaft 54 extending in the horizontal direction is provided downstream of each storage unit 10 in the transportation direction of the roll of coins. A torsion spring (not shown) is provided on the shaft 54 of the detecting lever 52 so that the detecting lever 52 is always urged by the torsion spring to rotate about the shaft 54 in the counterclockwise direction in FIGS. 3 and 4. A stopper (not shown) is provided in the vicinity of the detecting lever 52 so that the detecting lever 52 is restricted in its movement range by the stopper and does not rotate counterclockwise about the shaft 54 from the state shown in FIGS. 3 and 4, by means of the stopper. As shown in FIGS. 3 and 4, when the roll of coins is not in contact with the detecting lever 52, a distal end portion of the detecting lever 52 falls within the range of movement of the roll of coins hooked on the protruding members 44 provided on each endless belt 42 circulating in the counterclockwise direction in FIG. 3. As a result, when the roll of coins hooked on the protruding members 44 passes through the coin-roll characteristic-value detecting unit 50, the roll of coins contacts the distal end portion of the detecting lever 52, and then the detecting lever 52 is rotated in the clockwise direction in FIGS. 3 and 4 about the shaft 54, against the urging force of the torsion spring by being pushed by the roll of coins being transported by the transporting unit 40. At this time, the magnet 54*a* provided on the shaft 54 also rotates in the clockwise direction in FIGS. 3 and 4 in synchronization with the detecting lever 52, and based on the change in the magnetic field generated by the rotation of the magnet 54*a*, the angle sensor 55 detects the rotational angle of the detecting lever 52. In this way, the first characteristic value relating to the diameter of the roll of coins being transported by the transporting unit 40 is detected based on the rotational angle of the detecting lever 52 detected by the angle sensor 55. In such a manner, when detecting the rotational angle of the detecting lever 52 by the angle sensor 55 based on the change in the magnetic field generated by the movement of the magnet 54*a*, the rotational angle of the detecting lever 52 can be detected accurately. Therefore, it is possible to accurately detect the first characteristic value relating to the diameter of the roll of coins.

In the present embodiment, as shown in FIGS. 3 and 4, the detecting lever 52 is installed in the same area as the roll of coins transported by the transporting unit 40 with respect to the endless belts 42 of the transporting unit 40. In other words, the detecting lever 52 is installed in the same side as the side on which the protruding members 44 are provided, with respect to the endless belt 42 of the transporting unit 40. As a result, the roll of coins being transported by the transporting unit 40 assuredly comes into contact with the detecting lever 52, so that it is possible to reliably detect the first characteristic value relating to the diameter of the roll of coins. Further, in the present embodiment, at least a part of the detecting lever 52 is made of resin. This makes it possible to prevent a magnetic field generated in the vicinity of the magnet 54*a* and a circuit 58*a* which will be described later from being disturbed by the detecting lever 52.

As shown in FIGS. 3 and 4, the coin-roll characteristic-value detecting unit 50 includes at least a circuit 58*a* and a sensor 58*b*. The circuit 58*a* includes a coil and a capacitor. The sensor 58*b* detects an impedance characteristic and an inductance characteristic of the circuit 58*a*. An alternating current is applied to the coil of the circuit 58*a* whereby a predetermined magnetic field is generated near the circuit 58*a*. When the roll of coins being transported by the transporting unit 40 passes the coin-roll characteristic-value detecting unit 50, changes in the impedance characteristic and the inductance characteristic of the circuit 58*a*, resulting from a shift of the roll of coins by a predetermined distance set previously, is detected by the sensor 58*b*. The second characteristic value relating to the material of the roll of coins transported by the transporting unit 40 is detected based on changes in the impedance characteristic and the inductance characteristic of the circuit 58*a*. In the present embodiment, a second characteristic-value detecting portion for detecting the second characteristic value relating to the material of the roll of coins being transported by the transporting unit 40 is constituted by the circuit 58*a* and the sensor 58*b*. Hereinafter, details of each constituent member in such a second characteristic-value detecting portion will be described.

As shown in FIGS. 3 and 4, the circuit 58*a* is disposed in a region closer to the endless belts 42 than the roll of coins transported by the transporting unit 40. More specifically, the circuit 58*a* is provided on a back side of the endless belts 42. It should be noted that the circuit 58*a* may be arranged between each endless belt 42 and not the back side of the endless belts 42. In the present embodiment, it is preferable to arrange the circuit 58*a* as close as possible to the roll of coins being transported by the transporting unit 40. Further, as described above, an alternating current is passed through the coil of the circuit 58*a*, and the predetermined magnetic field is generated in the vicinity of the circuit 58*a*. When the roll of coins hooked on the protruding members 44 passes through the coin-roll characteristic-value detecting unit 50, the magnetic field generated near the circuit 58*a* is disturbed by the roll of coins and the impedance characteristic and the inductance characteristic of the circuit 58*a* are changed. Such changes in the impedance characteristic and the inductance characteristic of the circuit 58*a* differs depending on the material of the roll of coins passing through the coin-roll characteristic-value detecting unit 50. Then, by detecting the changes in the impedance characteristic and the inductance characteristic of the circuit 58*a* by the sensor 58*b*, the second characteristic value relating to the material of the roll of coins being transported by the transporting unit 40 is detected. Here, as described above, by placing the circuit 58*a* as close as possible to the roll of coins being transported by the transporting unit 40, it is possible to accurately detect the second characteristic value relating to the material of the roll of coins.

In such a manner, the first characteristic value relating to the diameter of the roll of coins and the second characteristic value relating to the material of the roll of coins detected by the coin-roll characteristic-value detecting unit 50 are sent to the later-explained controlling unit 90. The controlling unit 90 includes a later-explained denomination determining unit 92. The denomination determining unit 92 determines a denomination of the roll of coins based on the first characteristic value relating to the diameter of the roll of coins and the second characteristic value relating to the material of the roll of coins.

Further, as shown in FIG. 3, the coin-roll characteristic-value detecting unit 50 has a temperature sensor, and with such a temperature sensor, temperatures in the vicinity of the detecting lever 52 in the first characteristic-value detecting portion and the circuit 58*a* in the second characteristic-value detecting portion are detected. The temperature sensor is integrally provided inside the circuit 58*a*. Further, in the present embodiment, the rotational angle of the detecting lever 52 detected by the angle sensor 55 is corrected based on the temperature detected by the temperature sensor, and based on this corrected value, the first characteristic value relating to the diameter of the roll of coins being transported by the transporting unit 40 may be detected. Also, based on the temperature detected by the temperature sensor, the amount of changes in the impedance characteristic and the inductance characteristic of the circuit 58*a* is corrected, and based on the corrected value, the second characteristic value relating to the material of the roll of coins being transported by the transporting unit 40 may be detected. Although FIG. 3 shows a configuration example in which such a temperature sensor is integrally provided inside the circuit 58*a*, a temperature sensor may be provided separately from the circuit 58*a*.

As shown in FIGS. 3 and 4, in the coin-roll characteristic-value detecting unit 50, a sensor 59, such as a photo-interrupter and the like, is arranged upstream of both the detecting lever 52 and the circuit 58*a* in the transportation direction of the roll of coins. The roll of coins transported by the transporting unit 40 is detected by the sensor 59 before the roll of coins reaches the detecting lever 52 and the circuit 58*a*. By detecting the roll of coins with the sensor 59 arranged upstream of the detecting lever 52 and the circuit 58*a* in the transportation direction of the roll of coins, a timing of the start of the detection in the coin-roll characteristic-value detecting unit 50 of the first characteristic value relating to the diameter and the second characteristic value relating to the material of the roll of coins can be decided.

The rejecting unit 60 is arranged further downstream of the coin-roll characteristic-value detecting unit 50 in the transportation direction of the roll of coins when transported by the transporting unit 40. The roll of coins that is determined by the denomination determining unit 92 to be of a denomination that should not be ejected out of the housing 2 is sent from the transporting unit 40 to the rejecting unit 60. More particularly, a diverting lever 62 is pivotably mounted about a shaft 64 near the rejecting unit 60, and the roll of coins transported by the transporting unit 40 (specifically, the roll of coins transported by the endless belts 42 in the state of being hooked on the protruding members 44) is diverted by the diverting lever 62 so as to be sent from the transporting unit 40 to the rejecting unit 60. Specifically, the diverting lever 62 is rotatable about the shaft 64 between an advanced position and a retracted position. The advanced position is a position in the movement area of the roll of coins transported by the transporting unit 40. The retracted position is a position that is not in this movement area. When the diverting lever 62 is located in the advanced position, the roll of coins being transported by the endless belts 42 in the state of being hooked on the protruding members 44 contacts the diverting lever 62, comes off from the protruding members 44, and is sent to the rejecting unit 60. Alternatively, when the diverting lever 62 is located in the retracted position, the roll of coins transported by the transporting unit 40 is not sent to the rejecting unit 60.

As shown in FIG. 3, the rejecting unit 60 includes a full-state detection sensor 66. The full-state detection sensor 66 detects whether the rejecting unit 60 is full with or almost full with the rolls of coins. Specifically, the full-state detection sensor 66 includes a light emitting element and a light receiving element arranged with a space therebetween, and light emitted from the light emitting element is received by the light receiving element. When the rejecting unit 60 is full with or almost full with the rolls of coins whereby an optical path between the light emitting element and the light receiving element is blocked by those rolls of coins, the full-state detection sensor 66 detects that the rejecting unit 60 is full with or almost full with the rolls of coins.

As shown in FIGS. 1, 3 and 5, and the like, the ejecting unit 70 is arranged in a front upper part of the coin-roll handling device 1 according to the present embodiment. The ejecting unit 70 ejects the roll of coins transported by the transporting unit 40 from the inside to the outside of the housing 2. As shown in FIG. 3, the ejecting unit 70 includes a coin-roll accommodating section 72 that accommodates the roll of coins transported by the transporting unit 40. An opening 2*a* is provided in a front surface of the housing 2. The roll of coins is sent from the inside of the housing 2 to the coin-roll accommodating section 72 of the ejecting unit 70 via the opening 2*a*. A diverting lever 78 is arranged in the housing 2 near the ejecting unit 70. The roll of coins being transported by the transporting unit 40 is diverted by the diverting lever 78 to be sent from the transporting unit 40 to the ejecting unit 70 via the opening 2*a*, and accommodated in the coin-roll accommodating section 72 of the ejecting unit 70. More particularly, the diverting lever 78 is movable between an advanced position and a retracted position. The advanced position is a position in a movement area of the roll of coins transported by the transporting unit 40. The retracted position is a position that is not in this movement area. When the diverting lever 78 is located in the advanced position, the roll of coins being transported by the transporting unit 40 is sent to the ejecting unit 70 by the diverting lever 78. Alternatively, when the diverting lever 78 is located in the retracted position, the roll of coins being transported by the transporting unit 40 is not sent to the ejecting unit 70. Further, a rubber plate for absorbing shock is provided at the bottom of the coin-roll accommodating section 72. When the roll of coins diverted from the transporting unit 40 by the diverting lever 78 is sent to the ejecting unit 70 via the opening 2*a* and accommodated in the coin-roll accommodating section 72 of the ejecting unit 70, the roll of coins falling into the coin-roll accommodating section 72 can be prevented from jumping up greatly due to the rubber plate for absorbing impact.

As shown in FIGS. 3 and 4, a shutter 76 (a dispensing passage shutter) is provided in the front surface of the housing 2 near the opening 2*a* to open or close the opening 2*a*. The shutter 76 is movable in the vertical direction in FIGS. 3 and 4. When the opening 2*a* is in the opened state by operation of the shutter 76, the roll of coins can be sent from the transporting unit 40 to the ejecting unit 70.

The ejecting unit 70 includes a shutter 74 rotatable about a shaft 74*a*. As shown by the arrow in FIG. 3, by opening the shutter 74 so that the shutter 74 is reclined forward from a front surface 71 of the ejecting unit 70 (the opened shutter 74 is indicated by a two-dot chain line in FIG. 3), it is possible to access the roll of coins accommodated in the coin-roll accommodating section 72 of the ejecting unit 70 from outside the housing 2 so as to be able to take out the roll of coins from the ejecting unit 70.

As shown in FIG. 3, the coin-roll handling device 1 according to the present embodiment includes the controlling unit 90. The ejecting mechanism 19 of each of the storage units 10, the driving motor 46 of the transporting unit 40, the coin-roll characteristic-value detecting unit 50, the diverting lever 62, the diverting lever 78, the shutter 76, and the like are communicatively connected to the controlling unit 90. Detection results (specifically, the first characteristic value relating to the diameter of the roll of coins and the second characteristic value relating to the material of the roll of coins) obtained by the coin-roll characteristic-value detecting unit 50 are sent to the controlling unit 90. The controlling unit 90 controls the various components, such as the ejecting mechanism 19 of each of the storage units 10, the driving motor 46 of the transporting unit 40, the diverting lever 62, the diverting lever 78, and the shutter 76, by sending a command signal to the corresponding component. Moreover, the controlling unit 90 includes the denomination determining unit 92 that determines the denomination of the roll of coins ejected from each of the storage units 10 by the ejecting mechanism 19. The denomination determining unit 92 determines the denomination of the roll of coins based on the first characteristic value relating to the diameter and the second characteristic value relating to the material of the roll of coins, both detected by the coin-roll characteristic-value detecting unit 50.

In the present embodiment, the coin-roll handling device 1 acts as a safe and only an authorized person (for example, a supervisor of the shop in which the coin-roll handling device 1 is installed) can access the inside of the safe. Specifically, as shown in FIG. 1, a front lower part of the housing 2 is provided with a lower part door 4 having a keylock 6. Only the authorized person can open the lower part door 4 by unlocking the keylock 6 with a key possessed by him or her and access the inside of the housing 2. In this manner, in the coin-roll handling device 1 according to the present embodiment, the storage units 10, the transporting unit 40, and the coin-roll characteristic-value detecting unit 50 are all arranged inside the safe, and access to the inside of the safe is restricted to the authorized person.

An operation of the coin-roll handling device 1 having such a configuration is explained below. The operation of the coin-roll handling device 1 explained below is performed by the controlling unit 90 by controlling the various components of the coin-roll handling device 1.

A dispensing process of the roll of coins in which the roll of coins is ejected to outside of the housing 2 from inside of the coin-roll handling device 1 according to the present embodiment is explained below. In the coin-roll handling device 1, when an instruction to perform the dispensing process of the roll of coins is inputted into the controlling unit 90 via an operating unit (not-shown), the roll of coins is fed out from each storage unit 10 by the ejecting mechanism 19, and the fed-out roll of coins is transported one by one by the transporting unit 40. Specifically, the roll of coins fed out from each storage unit 10 by the ejecting mechanism 19 is transported by the endless belts 42, in the state of being hooked on the protruding members 44, in the direction shown with the straight arrow in FIG. 3. Then, when the roll of coins being transported by the transporting unit 40 is detected by the sensor 59, detection of the first characteristic value relating to the diameter of the roll of coins and the second characteristic value of the material of the roll of coins by the coin-roll characteristic-value detecting unit 50 is started. Specifically, when the roll of coins hooked on the protruding members 44 in the transporting unit 40 passes through the coin-roll characteristic-value detecting unit 50, the roll of coins contacts the distal end portion of the detecting lever 52. Then, the detecting lever 52 is pushed by the roll of coins being transported by the transporting unit 40 to rotate in the clockwise direction in FIGS. 3 and 4 about the shaft 54 against the urging force of the torsion spring. At this time, the magnet 54*a* provided on the shaft 54 also rotates in the clockwise direction in FIGS. 3 and 4 in synchronization with the detecting lever 52. Based on the change in the magnetic field generated by the rotation of the magnet 54*a*, the angle sensor 55 detects the rotational angle of the detecting lever 52. In this way, the first characteristic value relating to the diameter of the roll of coins being transported by the transporting unit 40 is detected based on the rotational angle of the detecting lever 52 detected by the angle sensor 55. Also, when the roll of coins hooked on the protruding members 44 passes through the coin-roll characteristic-value detecting unit 50, the magnetic field generated in the vicinity of the circuit 58*a* is disturbed by this roll of coins, and therefore the impedance characteristic and the inductance characteristic of the circuit 58*a* are changed. Then, by detecting the changes in the impedance characteristic and the inductance characteristic of the circuit 58*a* by the sensor 58*b*, the second characteristic value relating to the material of the roll of coins being transported by the transporting unit 40 is detected.

Both the first characteristic value relating to the diameter of the roll of coins and the second characteristic value relating to the material of the roll of coins detected by the coin-roll characteristic-value detecting unit 50 are sent to the controlling unit 90. The denomination of the roll of coins is determined by the denomination determining unit 92 of the controlling unit 90 based on both the first characteristic value relating to the diameter of the roll of coins and the second characteristic value relating to the material of the roll of coins.

The roll of coins that has passed the coin-roll characteristic-value detecting unit 50 is further transported by the transporting unit 40. The roll of coins that is determined by the denomination determining unit 92 to be of a denomination that should not be ejected from the inside to the outside of the housing 2 is diverted by the diverting lever 62 from the transporting unit 40 and sent to the rejecting unit 60. Alternatively, the roll of coins that is determined by the denomination determining unit 92 to be of a denomination that should be ejected from the housing 2 is diverted by the diverting lever 78 from the transporting unit 40 and sent to the coin-roll accommodating section 72 of the ejecting unit 70 via the opening 2*a*. When all the rolls of coins of a predetermined quantity of a desired denomination are fed out from the storage units 10 and sent to the ejecting unit 70, the operator can open the shutter 74 of the ejecting unit 70 so that the shutter 74 is reclined toward the front side of the front surface 71 of the ejecting unit 70. As a result, the operator can access the rolls of coins accommodated in the coin-roll accommodating section 72 of the ejecting unit 70 from the outside of the housing 2 so that the rolls of coins can be taken out of the ejecting unit 70.

According to the coin-roll handling device 1 of the present embodiment having the above configuration and the coin-roll handling method implemented by such a coin-roll handling device 1, the coin-roll characteristic-value detecting unit 50 is provided downstream of each storage unit 10 in the transportation direction of the roll of coins by the transporting unit 40 and the first characteristic value relating to the diameter of the roll of coins being transported by the transporting unit 40 and the second characteristic value relating to the material of the roll of coins being transported by the transporting unit 40 are detected by the coin-roll characteristic-value detecting unit 50. Further, the denomination of the roll of coins is determined by the denomination determining unit 92 based on the first characteristic value relating to the diameter of the roll of coins and the second characteristic value relating to the material of the roll of coins detected by the coin-roll characteristic-value detecting unit 50. Therefore, when the operator replenishes each storage unit 10 with an incorrect denomination roll of coins, such an incorrect operation by the operator can be detected. Further, according to the coin-roll handling device 1, since the first characteristic value relating to the diameter of the roll of coins and the second characteristic value relating to the material of the roll of coins being transported by the transporting unit 40 are detected, and the denomination of the roll of coins is determined based on the detected first characteristic value relating to the diameter of the roll of coins and the detected second characteristic value relating to the material of the roll of coins, it is possible to quickly and reliably distinguish the denomination of the roll of coins.

In the coin-roll handling device 1 described above, the first characteristic value relating to the diameter of the roll of coins being transported by the transporting unit 40 and the second characteristic value relating to the material of the roll of coins being transported by the transporting unit 40 are respectively detected by the coin-roll characteristic-value detecting unit 50, and the denomination determining unit 92 determines the denomination of the roll of coins based on both the first characteristic value relating to the diameter of the roll of coins and the second characteristic value relating to the material of the roll of coins detected by the coin-roll characteristic-value detecting unit 50. However, the coin-roll handling device 1 according to the present embodiment is not limited to such an aspect. The coin-roll characteristic-value detecting unit 50 may detect only one characteristic value among the first characteristic value relating to the diameter of the roll of coins and the second characteristic value relating to the material of the roll of coins, and the denomination determining unit 92 may determine the denomination of the roll of coins based on only one of the first characteristic value relating to the diameter of the roll of coins and the second characteristic value relating to the material of the roll of coins.

Depending on the country or organization issuing the coin, the denomination of the coin may not be reliably discriminated only by the first characteristic value relating to the diameter of the coin. In such a case, both the first characteristic value relating to the diameter of the roll of coins and the second characteristic value relating to the material of the roll of coins are detected by the coin-roll characteristic-value detecting unit 50, and the denomination of the roll of coins can be reliably determined by referring to both the first characteristic value relating to the diameter of the roll of coins and the second characteristic value relating to the material of the roll of coins. Specifically, in US dollar coins and euro coins, since the material of the coins having a diameter difference of 2 mm or less among the coins of a plurality of denominations is different, by detecting the second characteristic value relating to the material of the roll of coins and judging the difference in the material of the roll of coins, in addition to detecting the first characteristic value relating to the diameter of the roll of coins, the accuracy of discrimination of the denomination of the roll of coins is further enhanced.

Further, in the coin-roll handling device 1 of the present embodiment, as described above, there are provided the ejecting unit 70 configured to eject the roll of coins from the inside to the outside of the housing 2, the rejecting unit 60 and the diverting levers 62, 78 configured to divert the roll of coins being transported by the transporting unit 40 to either the ejecting unit 70 or the rejecting unit 60, respectively. Further, the roll of coins is diverted to the ejecting unit 70 from the transporting unit 40 by the diverting lever 78 if the denomination of the roll of coins is determined by the denomination determining unit 92 as the denomination of the roll of coins to be ejected from the inside to the outside of the housing 2, and the roll of coins is diverted to the rejecting unit 60 from the transporting unit 40 by the diverting lever 62 if the denomination of the roll of coins is determined by the denomination determining unit 92 as not being the denomination to be ejected from the housing 2.

Further, in the coin-roll handling device 1 of the present embodiment, as described above, the coin-roll characteristic-value detecting unit 50 includes, as the first characteristic-value detecting portion, the detecting lever 52 that is capable of contacting the roll of coins being transported by the transporting unit 40 and is rotatable about the shaft 54, the magnet 54*a* that rotates integrally with the detecting lever 52, and the angle sensor 55 that detects the rotational angle of the detecting lever 52 when the roll of coins being transported by the transporting unit 40 comes into contact with the detecting lever 52. The angle sensor 55 detects the rotational angle of the detecting lever 52 based on the change of the magnetic field caused by the rotation of the magnet 54*a*. Further, the first characteristic value relating to the diameter of the roll of coins being transported by the transporting unit 40 is detected based on the rotational angle of the detecting lever 52. In this manner, when the rotational angle of the detecting lever 52 is detected by the angle sensor 55 based on the change in the magnetic field generated by the movement of the magnet 54*a*, the rotational angle of the detecting lever 52 can be detected accurately, and then it is possible to accurately detect the first characteristic value relating to the diameter of the roll of coins.

In this case, the rotational angle of the detecting lever 52 detected by the angle sensor 55 may be corrected based on the temperature detected by the temperature sensor. Then, based on this corrected value, the first characteristic value relating to the diameter of the roll of coins being transported by the transporting unit 40 may be detected. In this case, even if the internal temperature of the housing 2 changes, and accordingly the detecting lever 52 expands or contracts, so that the rotational angle of the detecting lever 52 changes or the characteristic of the angle sensor 55 changes with temperature, the first characteristic value relating to the diameter of the roll of coins can be detected more accurately by correcting the rotational angle of the detecting lever 52 detected by the angle sensor 55 based on the temperature detected by the temperature sensor. Further, at least a part of the detecting lever 52 may be made of resin. This makes it possible to prevent the magnetic field generated in the vicinity of the magnet 54*a* and the circuit 58*a* from being disturbed by the detecting lever 52. In addition, the transporting unit 40 includes the endless belts 42 as a linearly extending transporting member and the roll of coins is transported along a direction in which the endless belt 42 extends. The detecting lever 52 is disposed in a region on the same side as the roll of coins transported by the transporting unit 40 with respect to the endless belts 42. In this case, the roll of coins transported by the transporting unit 40 assuredly comes into contact with the detecting lever 52, so that it is possible to reliably detect the first characteristic value relating to the diameter of the roll of coins.

Further, in the coin-roll handling device 1 of the present embodiment, as described above, the coin-roll characteristic-value detecting unit 50 includes, as the second characteristic-value detecting portion for detecting the second characteristic value relating to the material of the roll of coins, the circuit 58*a* including at least the coil and the capacitor and the sensor 58*b* for detecting the impedance characteristic and the inductance characteristic of the circuit 58*a*. The magnetic field is generated in the vicinity of the circuit 58*a* by the alternating current flowing through the coil of the circuit 58*a*. Further, the second characteristic value is detected based on the amount of changes in the impedance characteristic and the inductance characteristic of the circuit 58*a* when the roll of coins transported by the transporting unit 40 passes through the vicinity of the circuit 58*a*.

The circuit 58*a* is disposed in the region closer to the endless belts 42 than the roll of coins transported by the transporting unit 40. More specifically, the circuit 58*a* is provided on the backside of the endless belts 42. It should be noted that the circuit 58*a* may be arranged between each endless belt 42 and not the backside of the endless belts 42. In such a manner, it is preferable to arrange the circuit 58*a* as close as possible to the roll of coins being transported by the transporting unit 40 and this makes it possible to accurately detect the second characteristic value relating to the material of the roll of coins. Further, based on the temperature detected by the temperature sensor, the amount of changes in the impedance characteristic and the inductance characteristic of the circuit 58*a* may be corrected, and then based on the corrected value, the second characteristic value relating to the material of the roll of coins being transported by the transporting unit 40 may be detected. In this case, even if the internal temperature of the housing 2 changes, and accordingly the coil and the like of the circuit 58*a* expands or contracts and the magnetic field generated around the circuit 58*a* changes or the characteristics of the sensor 58*b* change with temperature, the second characteristic value relating to the material of the roll of coins can be detected more accurately by correcting the amount of changes in the impedance characteristic and the inductance characteristic of the circuit 58*a*.

Further, in the coin-roll handling device 1 of the present embodiment, as described above, the transporting unit 40 includes a plurality of endless belts 42 arranged in parallel and each of which has a plurality of protruding members 44 on which the roll of coins is hooked, and in each of the endless belts 42, each of the protruding members 44 is formed to project out such that a surface of the protruding member 44 contacting the roll of coins extends in a direction inclined with respect to a direction in which the endless belt 42 extends. Then, the roll of coins hooked on the protruding members 44 is shifted toward the endless belts 42 on the protruding member 44 under their own weight. Further, in each of the endless belts 42, the protruding members 44 of the endless belts 42 are arranged in a same phase in a movement direction of the endless belts 42. As a result, the roll of coins is transported by the transporting unit 40 while being hooked on a plurality of the protruding members 44 provided in the same phase in each endless belt 42.

Further, in the coin-roll handling device 1 of the present embodiment, as described above, each sensor 47 is arranged as a coin-roll detecting sensor for detecting the roll of coins ejected from each storage unit 10 by the ejecting mechanism 19, and the sensor 47 is also capable of detecting each of the protruding members 44 of the transporting unit 40. In this case, each sensor 47 used as the coin-roll detecting sensor can also be used as a sensor for detecting the operation of the endless belt 42.

Further, in the coin-roll handling device 1 of the present embodiment, as described above, there is provided the shutter 76 (first shutter) capable of being opened and closed between the transporting unit 40 and the ejecting unit 70, and the roll of coins is sent from the transporting unit 40 to the ejecting unit 70 by opening the shutter 76.

Further, in the coin-roll handling device 1 of the present embodiment, as described above, the rejecting unit 60 is provided with the full-state detection sensor 66 that detects when the rejecting unit 60 becomes full with or almost full with the rolls of coins.

Further, in the coin-roll handling device 1 of the present embodiment, as described above, the ejecting unit 70 is provided with the shutter 74 (second shutter) that selectively enables access to the roll of coins sent from the transporting unit 40 to the ejecting unit 70, and when the shutter 74 is opened, it becomes possible to access the roll of coins in the ejecting unit 70 from outside of the housing 2.

Further, in the coin-roll handling device 1 of the present embodiment, as described above, the coin receiving unit 48 that receives any coin dropped from the transporting unit 40 is provided below the transporting unit 40. In this case, even if the packaging paper of the roll of coins being transported by the transporting unit 40 is torn and the coins fall down under their own weight, such coins are received by the coin receiving unit 48. Therefore, scattering of such coins inside the housing 2 can be prevented.

Further, in the coin-roll handling device 1 of the present embodiment, as described above, each storage unit 10, the transporting unit 40 and the coin-roll characteristic-value detecting unit 50 are provided inside the safe that only a person with predetermined authority has access thereto.

It should be noted that the coin-roll handling device and the coin-roll ejecting method according to the present invention are not limited to the above-described aspects, and various modifications can be made.

For example, as a coin-roll handling device according to the present invention, one having a configuration capable of returning the roll of coins from the transporting unit 40 to each storage unit 10 may be used. According to such a coin-roll handling device, when conducting a reconciliation process for checking the amount of the roll of coins stored in each storage unit 10, the roll of coins is ejected from each storage unit 10 by the ejecting mechanism 19 and the roll of coins ejected from the storage unit 10 is transported by the transporting unit 40. Then, after at least one of the first characteristic value relating to the diameter of the roll of coins and the second characteristic value relating to the material of the roll of coins being transported by the transporting unit 40 is detected by the coin-roll characteristic-value detecting unit 50, the roll of coins is returned to each storage unit 10. Further, in such a coin-roll handling device, when conducting the reconciliation process of the roll of coins, the denomination of the roll of coins is determined based on at least one of the first characteristic value relating to the diameter of the roll of coins and the second characteristic value relating to the material of the roll of coins detected by coin-roll characteristic-value detecting unit 50. As a result, when the operator replenishes each storage unit 10 with the roll of coins of incorrect denomination, such an incorrect operation by the operator can be detected by conducting the reconciliation process.

In addition, the coin-roll handling device according to the present invention is not limited to a configuration in which each storage unit 10 is provided inside the housing 2 as shown in FIG. 3 and the like. The principle of the present invention can also be applied to a coin-roll handling device in which a storage unit for storing the roll of coins is not provided. That is, if the coin-roll handling device according to the present invention is provided with the transporting unit configured to transport the roll of coins in the housing, the coin-roll characteristic-value detecting unit configured to detect at least one of the first characteristic value relating to the diameter of the roll of coins being transported by the transporting unit and the second characteristic value relating to the material of the roll of coins being transported by the transporting unit, and the denomination determining unit configured to determine the denomination of the roll of coins based on at least one of the first characteristic value relating to the diameter of the roll of coins and the second characteristic value relating to the material of the roll of coins detected by the coin-roll characteristic-value detecting unit, the coin-roll handling device not provided with the storage unit that stores the roll of coins and can feed the stored roll of coins to the transporting unit may be used.

Figure 6:
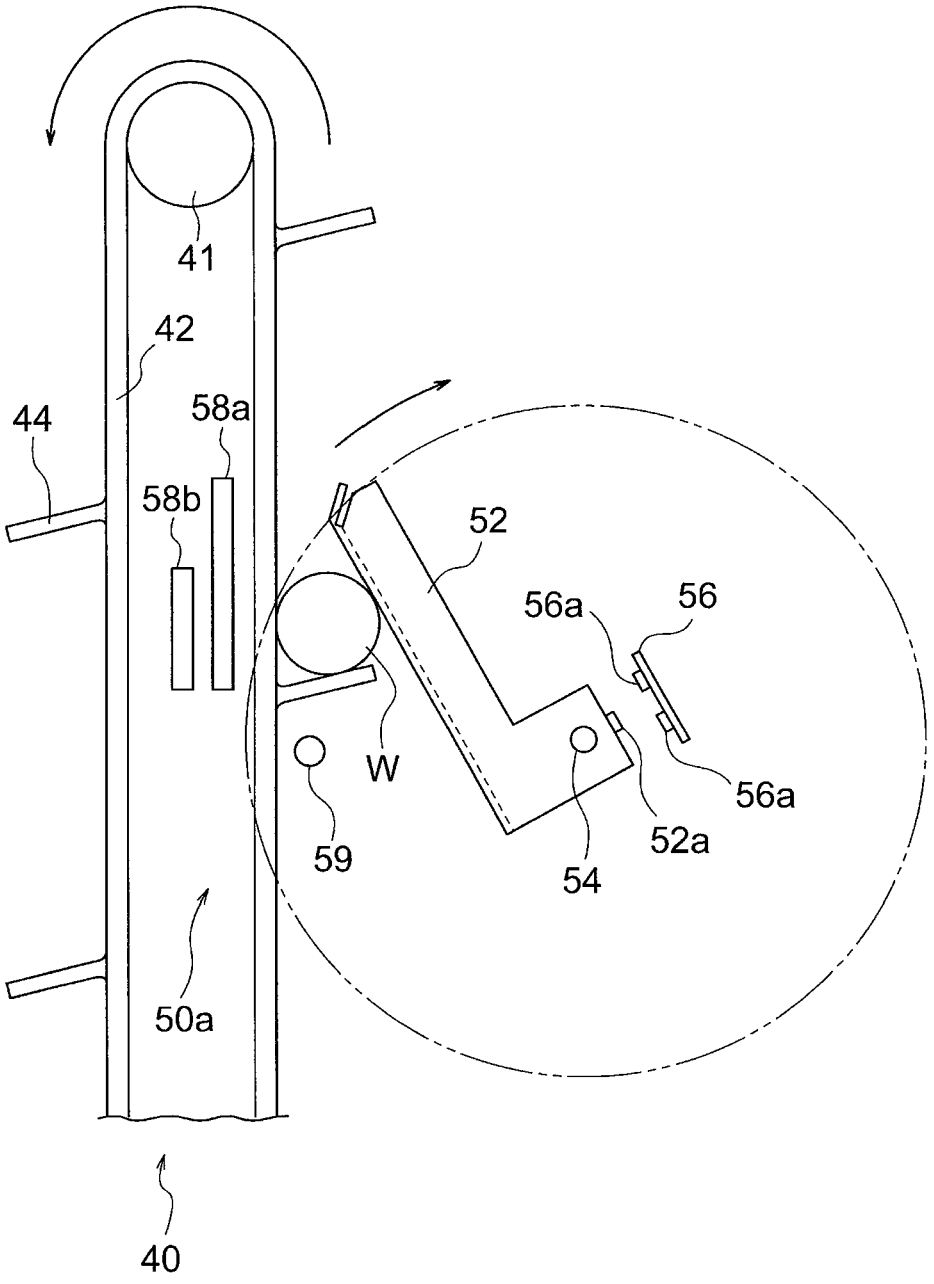

In addition, as a coin-roll characteristic-value detecting unit 50*a* relating to the modified example, a configuration as shown in FIG. 6 may be used. In the coin-roll characteristic-value detecting unit 50*a* shown in FIG. 6, as the first characteristic-value detecting portion for detecting the first characteristic value relating to the diameter of the roll of coins, the detecting lever 52 that is contactable with the roll of coins being transported by the transporting unit 40 and is rotatable about the shaft 54, a magnet 52*a* provided on the proximal end portion of the detecting lever 52 and rotating integrally with the detecting lever 52 about the shaft 54, and a pair of hall elements 56*a* attached to a fixed member 56 are respectively provided. The rotational angle of the detecting lever 52 is detected by the pair of hall elements 56*a* based on the change in the magnetic field generated by the movement of the magnet 52*a*. The hall element 56*a* used in the coin-roll characteristic-value detecting unit 50*a* shown in FIG. 6 and the like is inexpensive as compared with the angle sensor 55 used in the coin-roll characteristic-value detecting unit 50 shown in FIG. 3 and the like. Therefore, the manufacturing cost of the coin-roll handling device 1 can be reduced. Further, in the case where the rotational angle of the detecting lever 52 is detected by the pair of hall elements 56*a* based on the change of the magnetic field generated by the movement of the magnet 52*a* in the coin-roll characteristic-value detecting unit 50*a* shown in FIG. 6 and the like, the rotational angle of the detecting lever 52 can be accurately detected, so that it is possible to accurately detect the first characteristic value relating to the diameter of the roll of coins.

Further, as a coin-roll characteristic-value detecting unit according to still another modified example (specifically, as the first characteristic-value detecting portion for detecting the first characteristic value relating to the diameter of the roll of coins), instead of detecting the first characteristic value relating to the diameter of the roll of coins based on the rotational angle of the detecting lever 52, the diameter of the roll of coins being transported by the transporting unit 40 may be detected by a sensor such as a photo-interrupter. A configuration example of the first characteristic-value detection part according to such a modified example will be described with reference to FIG. 7. In the example shown in FIG. 7, a sensor 94 such as a photo-interrupter including a light emitting element 94*a* and a light receiving element 94*b* is provided as the first characteristic-value detecting portion for detecting the first characteristic value relating to the diameter of the roll of coins. When the roll of coins hooked on the protruding members 44 is transported by the endless belts 42 in an arrow direction in FIG. 7 (that is, in the upward direction in FIG. 7), the length of time during which the roll of coins interrupts an optical path 94*c* between the light emitting element 94*a* and the light receiving element 94*b* (that is, the length of time during which light emitted from the light emitting element 94*a* is not received by the light receiving element 94*b*) is detected. Based on this time, the first characteristic value relating to the diameter of the roll of coins is detected. Specifically, a rotary encoder is provided to detect the movement of the endless belt 42, and the number of pulses of the rotary encoder during the time when the roll of coins intercepts the optical path 94*c* between the light emitting element 94*a* and the light receiving element 94*b* is detected as the first characteristic value.

Figure 7:
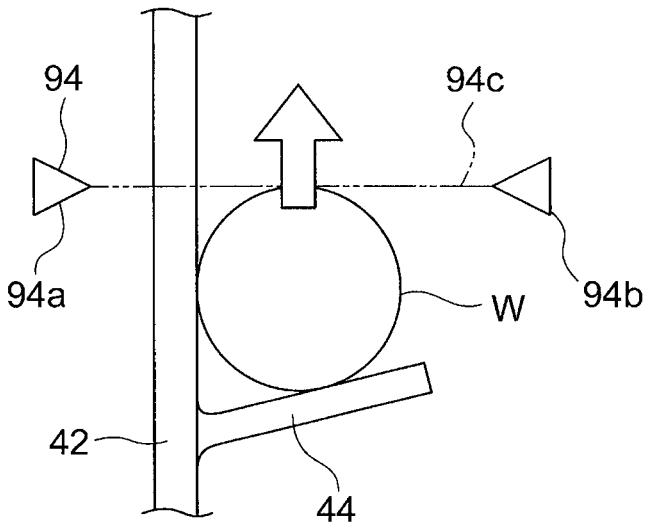
Figure 8:
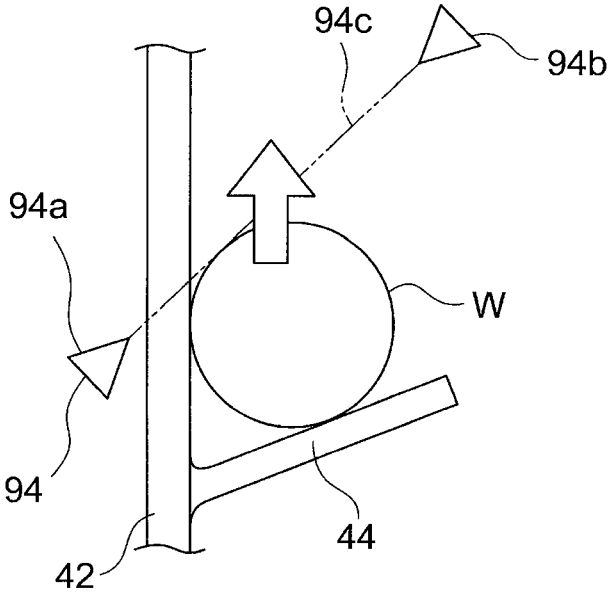
Figure 9:
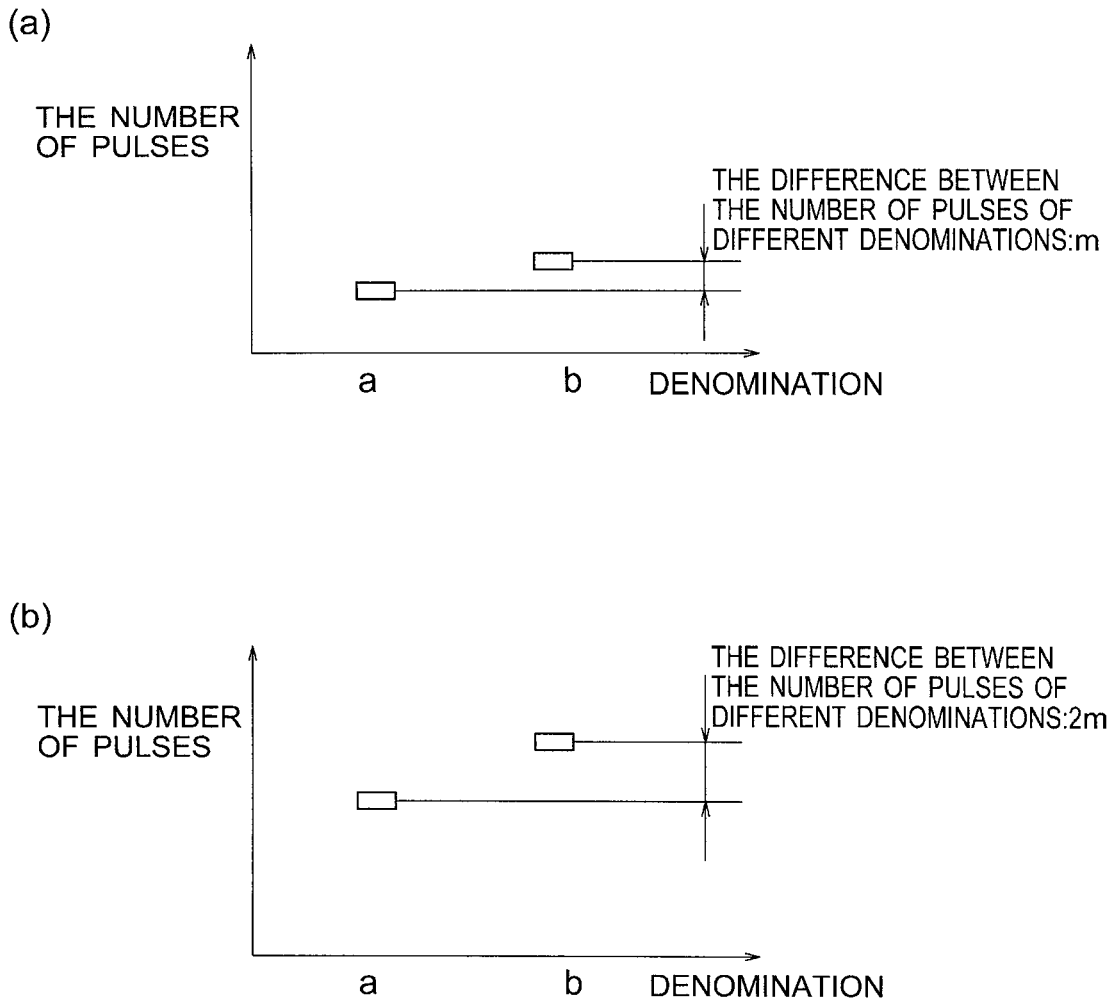
FIG. 9 is a graph showing the number of pulses of a rotary encoder for each denomination of the roll of coins detected by the sensor shown in FIGS. 7 and 8.

In the example shown in FIG. 7, the optical path 94*c* between the light emitting element 94*a* and the light receiving element 94*b* is orthogonal to the transportation direction of the roll of coins, but as another example of the first characteristic-value detecting portion, the light emitting element 94*a* and the light receiving element 94*b* may be arranged such that the optical path 94*c* between the light emitting element 94*a* and the light receiving element 94*b* is inclined at a predetermined angle (for example, 30 degrees) with respect to the transportation direction of the roll of coins. When the light emitting element 94*a* and the light receiving element 94*b* are disposed at the positions shown in FIG. 8, the length of time for which the roll of coins being transported by the transporting unit 40 interrupts the optical path 94*c* between the light emitting element 94*a* and the light receiving element 94*b* becomes longer, and then the first characteristic value (more specifically, the number of pulses of the rotary encoder) relating to the diameter of the roll of coins becomes large as compared with the case where the light emitting element 94*a* and the light receiving element 94*b* are disposed at the position as shown in FIG. 7. This makes it possible to improve the precision in determining the denomination of the roll of coins based on the first characteristic value relating to the diameter of the roll of coins. More specifically, when the light emitting element 94*a* and the light receiving element 94*b* are disposed at the positions shown in FIG. 7, the difference between the first characteristic value (more specifically, the number of pulses of the rotary encoder) in the roll of coins of mutually different denominations a and b is "m" as shown in FIG. 9(*a*). Alternatively, when the light emitting element 94*a* and the light receiving element 94*b* are disposed at the positions shown in FIG. 8, since the optical path 94*c* between the light emitting element 94*a* and the light receiving element 94*b* is interrupted by the roll of coins for a longer period of time (more specifically, it is twice as long, for example), the difference between the first characteristic value (more specifically, the number of pulses of the rotary encoder) in the roll of coins of mutually different denominations a and b is "2m" as shown in FIG. 9(*b*). In this way, when the light emitting element 94*a* and the light receiving element 94*b* are disposed at the positions shown in FIG. 8, the first characteristic value relating to the diameter of the roll of coins (specifically, the number of pulses of the rotary encoder) becomes large. Therefore, it is possible to improve accuracy in determining the denomination of the roll of coins based on the first characteristic value.

Figure 10:
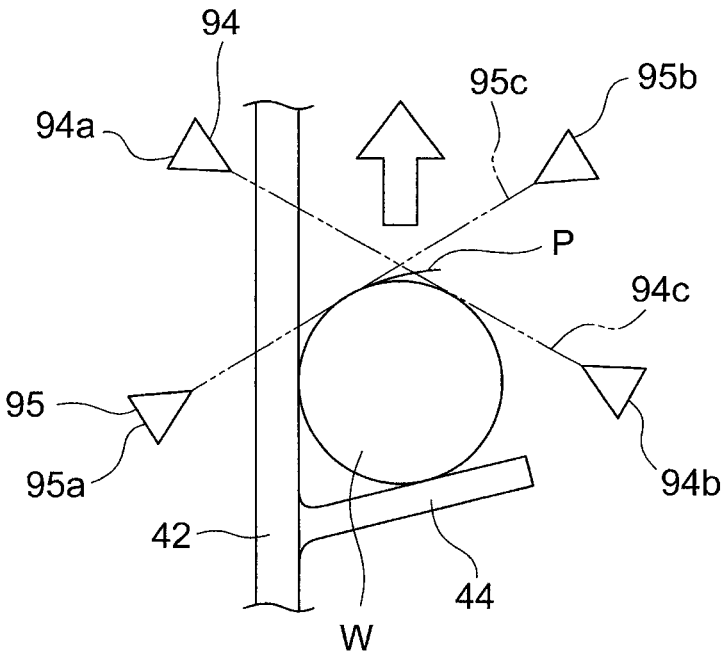

Further, as shown in FIG. 10, as the first characteristic value detecting portion for detecting the first characteristic value relating to the diameter of the roll of coins, two sensors 94, 95 such as two photo-interrupters having different directions of optical paths 94*c*, 95*c* may be arranged. In the first characteristic value detecting portion having such a configuration, the length of time during which the optical path 94*c* provided between the light emitting element 94*a* and the light receiving element 94*b* in the sensor 94 is interrupted by the roll of coins and the length of time during which the optical path 95*c* provided between a light emitting element 95*a* and a light receiving element 95*b* in the sensor 95 is interrupted by the roll of coins are respectively detected as the number of pulses of the rotary encoder. In the case where the two sensors 94 and 95 are arranged in this manner, when the wrapping paper of the roll of coins hooked on the protruding members 44 in the transporting unit 40 is partially peeled off (the peeled wrapping paper is indicated by reference symbol P in FIG. 10), the peeled portion of the wrapping paper interrupts the optical path 94*c* of the sensor 94, so that the first characteristic value relating to the diameter of the roll of coins detected by the sensor 94 becomes larger than the original value (that is, correct value). However, since the first characteristic value relating to the diameter of the roll of coins detected by the sensor 95 is still the original value, in the denomination determining unit 92, the denomination of the roll of coins can be accurately discriminated by referring to a smaller characteristic value among two first characteristic values relating to the diameter of the roll of coins detected by the sensors 94 and 95.

Figure 11:
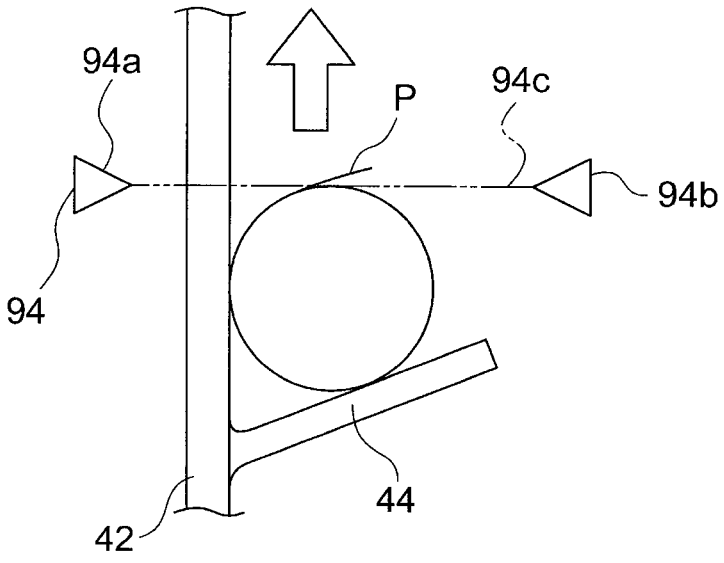
FIG. 11 is a side view showing a state when the first characteristic value relating to the diameter of the roll of coins in which a wrapping paper has partially peeled off is detected by one sensor as a comparative example.

As a comparative example, FIG. 11 shows the state when the first characteristic value relating to the diameter of the roll of coins where the wrapping paper has partially peeled off is detected by one sensor 94. As shown in FIG. 11, when the first characteristic value relating to the diameter of the roll of coins is detected by one sensor 94, if the wrapping paper of the roll of coins hooked on the protruding members 44 in the transporting unit 40 is partially peeled off (peeled wrapping paper is indicated by reference symbol P in FIG. 11), the peeled portion of the wrapping paper interrupts the optical path 94*c* of the sensor 94, whereby the first characteristic value relating to the diameter of the roll of coins (specifically, the number of pulses of the rotary encoder) becomes larger than the original value (that is, correct value). Therefore, the denomination determining unit 92 may erroneously determine the denomination of the roll of coins. Specifically the denomination of the roll of coins is erroneously determined by the denomination determining unit 92 as a denomination of the roll of coins having a larger diameter. Alternatively, when two sensors 94 and 95 having different directions of the optical paths 94*c* and 95*c* are arranged as shown in FIG. 10, even if the first characteristic value relating to the diameter of the roll of coins detected by one sensor (for example, sensor 94) becomes larger than the original value, the first characteristic value relating to the diameter of the roll of coins detected by the other sensor (for example, sensor 95) remains the original value. Therefore, by referring to a small characteristic value among two first characteristic values relating to the diameter of the roll of coins detected by the sensors 94 and 95 in the denomination determining unit 92, the denomination determining unit 92 can accurately determine the denomination of the roll of coins.

Further, as a coin-roll characteristic-value detecting unit according to still another modified example, in addition to detect the first characteristic value relating to the diameter of the roll of coins and the second characteristic value relating to the material of the roll of coins being transported by the transporting unit 40, one that detects a third characteristic value relating to a length of the roll of coins being transported by the transporting unit 40 may be used. In this case, the denomination determining unit 92 of the controlling unit 90 determines the denomination of the roll of coins based on the first characteristic value relating to the diameter of the roll of coins, the second characteristic value relating to the material of the roll of coins and the third characteristic value relating to the length of the roll of coins detected by the coin-roll characteristic-value detecting unit. Various examples of a configuration of a length detection mechanism for detecting the length of the roll of coins being transported by the transporting unit 40 will be described below.

Depending on the countries and organizations that issue coins, there are cases where it is not possible to reliably distinguish the denomination of the roll of coins by referring only to the first characteristic value relating to the diameter of the roll of coins and the second characteristic value relating to the material of the roll of coins. For example, consider the roll of coins of Hong Kong 50 cents and the roll of coins of Macau 10 Avos. Since the diameter of the former is 22.5 mm while the diameter of the latter is 22.0 mm, there is no big difference between the diameter of both rolls of coins. Therefore, it is impossible to accurately distinguish the roll of coins of both only with the first characteristic value relating to the diameter of the roll of coins. In addition, since the material of both rolls of coins is the same (specifically, nickel brass), it is not possible to reliably distinguish the denomination of the roll of coins by merely referring to the first characteristic value relating to the diameter of the roll of coins and the second characteristic value relating to the material of the roll of coins. In contrast, the length of a roll of coins of Hong Kong 50 cents is 91 mm and the length of a roll of coins of Macau 10 Avos is 53 mm, and therefore there is a big difference in the length of both. Therefore, if the length of the roll of coins being transported by the transporting unit 40 is detected, it is possible to distinguish the roll of coins of both in the denomination determining unit 92.

Figure 12:
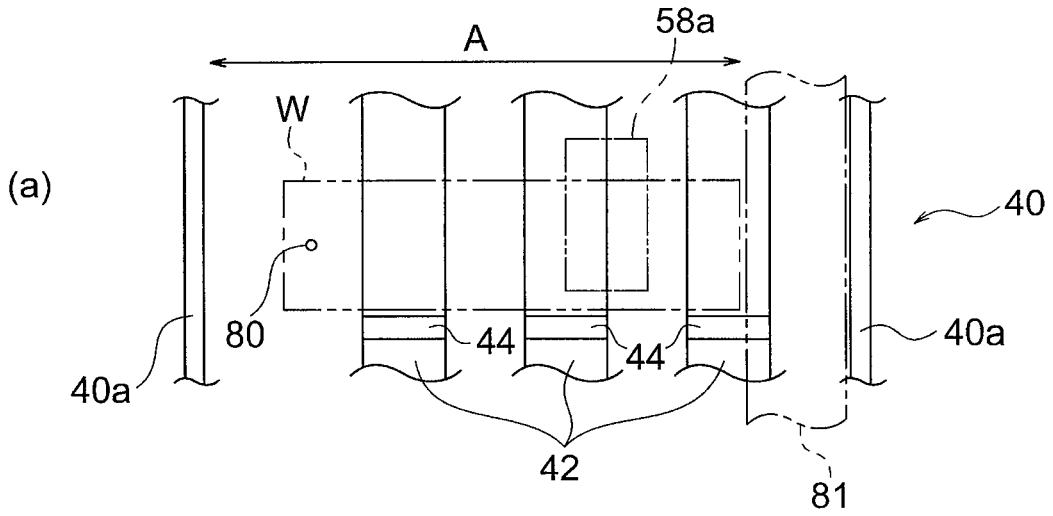
FIGS. 12 (*a*) and 12 (*b*) are side views showing a configuration for detecting a third characteristic value relating to a length of the roll of coins by the coin-roll characteristic-value detecting unit according to a modified example, in a state when the roll of coins having a length greater than a predetermined value is being transported while hooked on protruding members provided on each circulation belt.
Figure 12:
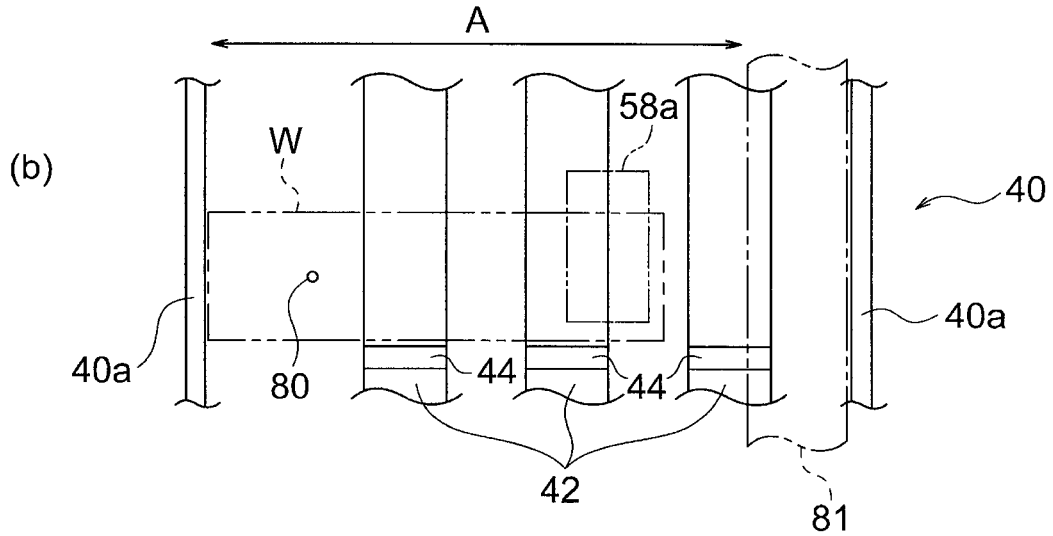
Figure 13:
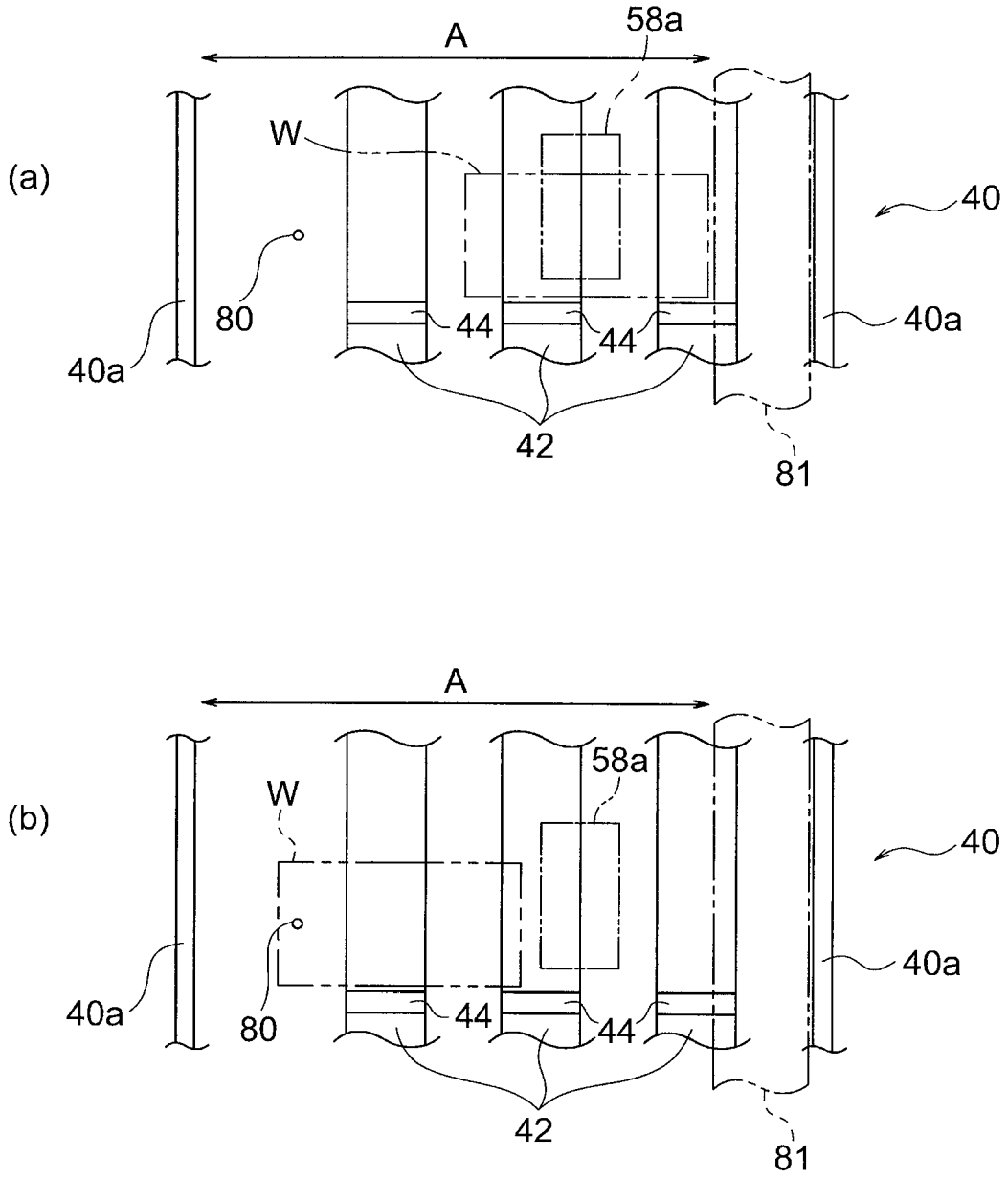
FIGS. 13 (*a*) and 13 (*b*) are side views showing a configuration for detecting the third characteristic value relating to the length of the roll of coins by the coin-roll characteristic-value detecting unit according to the modified example, in a state when the roll of coins having a length smaller than a predetermined value is being transported while hooked on the protruding members provided on each circulation belt.

As the length detection mechanism for detecting the length of the roll of coins being transported by the transporting unit 40, as shown in FIGS. 12 and 13, a detecting sensor 80 such as a photo-interrupter provided in the vicinity of the circuit 58*a* in the transporting unit 40 and detecting the roll of coins being transported while hooked on the protruding members 44 provided on each endless belt 42 can be used. In such a length detection mechanism using the detecting sensor 80, it is possible to detect whether or not the length of the roll of coins being transported by the transporting unit 40 is larger than a predetermined size. FIGS. 12 (*a*) and 12 (*b*) are side views showing a state when the roll of coins whose length is larger than a predetermined size is being transported while hooked on the protruding members 44 provided on each endless belt 42. FIGS. 13 (*a*) and 13 (*b*) are side views showing a state when the roll of coins whose length is smaller than a predetermined size is being transported while hooked on the protruding members 44 provided on each endless belt 42. In FIGS. 12 and 13, the roll of coins being transported while hooked on the protruding members 44 provided on each endless belt 42 is indicated by reference symbol W.

As shown in FIGS. 12 and 13, the transporting unit 40 has a pair of right and left guide portions 40*a* provided apart from each other, and the roll of coins is transported between these right and left guide portions 40*a* upward in FIGS. 12 and 13. Further, as shown in FIGS. 12 and 13, in the longitudinal direction of the roll of coins being transported while hooked on the protruding members 44 provided on each endless belt 42 (that is, the left-right direction in FIGS. 12 and 13), the detecting sensor 80 is provided so as to be aligned with the circuit 58*a*. The detecting sensor 80 is made of, for example, the photo-interrupter and the like, and can detect the roll of coins being transported while hooked on the protruding members 44 provided on each endless belt 42. In addition, as described above, when the roll of coins being transported while hooked on the protruding members 44 provided on each endless belt 42 passes through the circuit 58*a*, the magnetic field generated near the circuit 58*a* is disturbed by this roll of coins. Thereby, the impedance characteristic and the inductance characteristic of the circuit 58*a* are changed and changes in the impedance characteristic and the inductance characteristic of such a circuit 58*a* are detected by the sensor 58*b*.

Further, in the vicinity of one side end portion of the storage unit 10 in which the roll of coins whose length is smaller than a specific value among the storage units 10, a regulating unit 81 is provided for restricting the movement range of the roll of coins in the longitudinal direction. By such a regulating unit 81, the range of movement of the roll of coins being transported while hooked on the protruding members 44 provided on each endless belt 42 is restricted to the range indicated by the reference numeral A in FIGS. 12 and 13 by the regulating unit 81.

In the case of using the length detection mechanism having the detecting sensor 80 shown in FIGS. 12 and 13, when the detecting sensor 80 detects the roll of coins and the sensor 58*b* detects the changes of the impedance characteristic and the inductance characteristic of the circuit 58*a*, it is detected that the length of the roll of coins being transported while hooked on the protruding members 44 provided on each endless belt 42 is larger than the predetermined size. This is because, when the length of the roll of coins being transported while hooked on the protruding members 44 provided on each endless belt 42 is larger than the predetermined size as shown in FIGS. 12 (*a*) and 12 (*b*), the detecting sensor 80 detects the roll of coins and the impedance characteristic and the inductance characteristic of the circuit 58*a* are changed by the roll of coins passing through the circuit 58*a*, even if the roll of coins is positioned on the right side of the movement range A as shown in FIG. 12 (*a*), or even if the roll of coins is located on the left side of the movement range A as shown in FIG. 12 (*b*).

Alternatively, if the roll of coins is detected by the detecting sensor 80 but the sensor 58*b* does not detect the changes in the impedance characteristic and the inductance characteristic of the circuit 58*a*, or if the changes in the impedance characteristic and the inductance characteristic of the circuit 58*a* are detected by the sensor 58*b* but the roll of coins is not detected by the detecting sensor 80, it is detected that the length of the roll of coins being transported while hooked on the protruding members 44 provided on each endless belt 42 is smaller than a predetermined size by the length detection mechanism. As shown in FIGS. 13 (*a*) and 13 (*b*), when the length of the roll of coins being transported while hooked on the protruding members 44 provided on each endless belt 42 is smaller than a predetermined size, if the roll of coins is located on the right side of the movement range A as shown in FIG. 13 (*a*), the roll of coins is not detected by the detecting sensor 80, and if the roll of coins is located on the left side of the moving range A as shown in FIG. 13 (*b*), the roll of coins does not pass through the circuit 58*a*, so the impedance characteristic and the inductance characteristic of the circuit 58*a* are not changed. Further, when the length of the roll of coins being transported while hooked on the protruding members 44 provided on each endless belt 42 is smaller than the predetermined size, at any position in the moving range A the roll of coins is located, the roll of coins is not detected by the detecting sensor 80 or the changes of impedance characteristic and inductance characteristic of the circuit 58*a* are not detected by the sensor 58*b*.

In this way, the length detection mechanism using the detecting sensor 80 can detect whether or not the length of the roll of coins being transported by the transporting unit 40 is larger than a predetermined size based on the detection result of the roll of coins by the detecting sensor 80 and whether or not the sensor 58*b* detects the changes in the impedance characteristic and the inductance characteristic of the circuit 58*a*.

Figure 14:
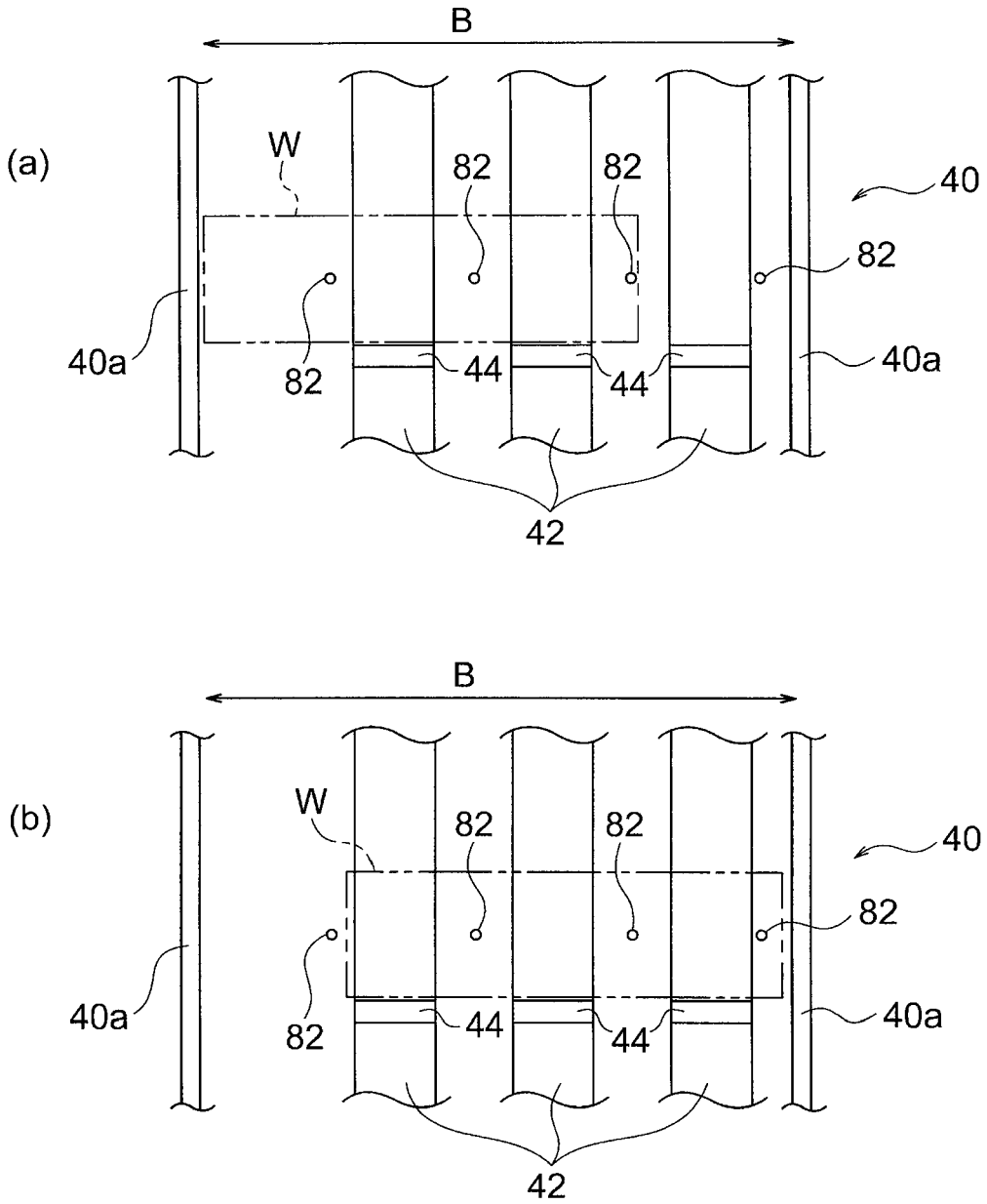
FIGS. 14 (*a*) and 14 (*b*) are side views showing a configuration for detecting the third characteristic value relating to the length of the roll of coins by the coin-roll characteristic-value detecting unit according to another modified example, in a state when the roll of coins having a length greater than a predetermined value is being transported while hooked on the protruding members provided on each circulation belt.
Figure 15:
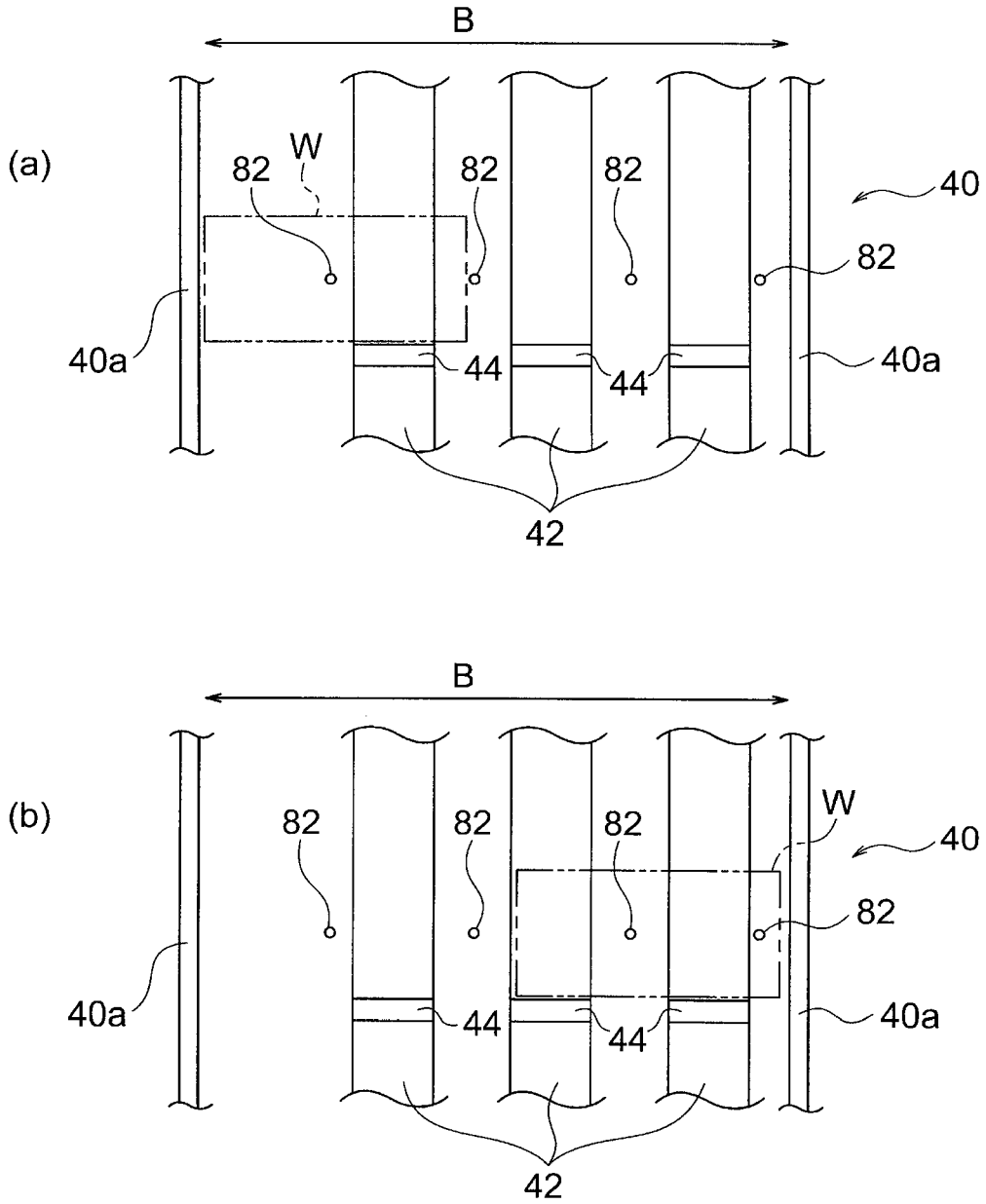
FIGS. 15 (*a*) and 15 (*b*) are side views showing a configuration for detecting the third characteristic value relating to the length of the roll of coins by the coin-roll characteristic-value detecting unit according to another modified example, in a state when the roll of coins having a length smaller than a predetermined value is being transported while hooked on the protruding members provided on each circulation belt.

The length detecting mechanism for detecting whether or not the length of the roll of coins being transported by the transporting unit 40 is larger than a predetermined value is not limited to the one using the detecting sensor 80 as shown in FIGS. 12 and 13. As the length detection mechanism for detecting whether or not the length of the roll of coins being transported by the transporting unit 40 is larger than a predetermined size, four detecting sensors 82 such as photo-interrupters arranged so as to be aligned along the longitudinal direction of the roll of coins being transported while hooked on the protruding members 44 provided on each endless belt 42 as shown in FIGS. 14 and 15 may be used. Another example of such a length detection mechanism using four detecting sensors 82 will be described below. FIGS. 14 (*a*) and 14 (*b*) are side views showing a state when the roll of coins whose length is larger than the predetermined value is being transported while hooked on the protruding members 44 provided on each endless belt 42. FIGS. 15 (*a*) and 15 (*b*) are side views showing a state when the roll of coins whose length is smaller than a predetermined value is being transported while hooked on the protruding members 44 provided on each endless belt 42. In FIGS. 14 and 15, the roll of coins being transported while hooked on the protruding members 44 provided on each endless belt 42 is indicated by reference symbol W.

As shown in FIGS. 14 and 15, the transporting unit 40 has the pair of right and left guide portions 40*a* provided apart from each other, and the roll of coins is transported between these right and left guide portions 40*a* upward in FIGS. 14 and 15. In the examples shown in FIGS. 14 and 15, the range of movement of the roll of coins being transported while hooked on the protruding members 44 provided on each endless belt 42 is limited to the range between the pair of right and left guide portions 40*a* (that is, the range indicated by reference symbol B in FIGS. 14 and 15).

As shown in FIGS. 14 and 15, four detecting sensors 82 are arranged in the longitudinal direction of the roll of coins being transported while hooked on the protruding members 44 provided on each endless belt 42 (that is, in the lateral direction in FIGS. 14 and 15). Each detecting sensor 82 is composed of, for example, a photo-interrupter and the like, and can detect the roll of coins being transported while hooked on the protruding members 44 provided on each endless belt 42. As shown in FIGS. 14 and 15, each detecting sensor 82 is disposed outside each endless belt 42 or between each endless belt 42 in the longitudinal direction of the roll of coins being transported while hooked on the protruding members 44 provided on each endless belt 42.

In the case of using the length detection mechanism having a plurality of detecting sensors 82 as shown in FIGS. 14 and 15, when the roll of coins is detected by at least three detecting sensors 82, it is detected that the length of the roll of coins being transported while hooked on the protruding members 44 provided on each endless belt 42 is larger than a predetermined value. As shown in FIGS. 14 (*a*) and 14 (*b*), when the length of the roll of coins being transported while hooked on the protruding member 44 provided on each endless belt 42 is larger than a predetermined value, the roll of coins is detected by at least three detecting sensors 82, even if the roll of coins is located on the left side of the movement range B as shown in FIG. 14 (*a*), or even if the roll of coins is located on the right side of the movement range B as shown in FIG. 14 (*b*). Further, when the length of the roll of coins being transported while hooked on the protruding members 44 provided on each endless belt 42 is larger than the predetermined size, at any position within the moving range B the roll of coins is located, the roll of coins is detected by three or four detecting sensors 82.

Alternatively, when the roll of coins is detected by two or less detecting sensors 82, it is detected that the length of the roll of coins being transported while hooked on the protruding members 44 provided on each endless belt 42 is smaller than a predetermined value by the length detection mechanism. As shown in FIGS. 15 (*a*) and 15 (*b*), when the length of the roll of coins being transported while hooked on the protruding members 44 provided on each endless belt 42 is smaller than the predetermined value, if the roll of coins is positioned on the left side of the moving range B as shown in FIG. 15 (*a*), the roll of coins is detected by one detecting sensor 82, and if the roll of coins is positioned on the right side of the moving range B as shown in FIG. 15 (*b*), the roll of coins is detected by two detecting sensors 82. Further, when the length of the roll of coins being transported while hooked on the protruding members 44 provided on each endless belt 42 is smaller than the predetermined value, at any position within the moving range B the roll of coins is located, the roll of coins is detected by one or two detecting sensors 82.

In this manner, the length detection mechanism using the four detecting sensors 82 detects whether or not the length of the roll of coins being transported by the transporting unit 40 is larger than a predetermined value based on the number of the detecting sensors 82 that detect the roll of coins.

Figure 16:
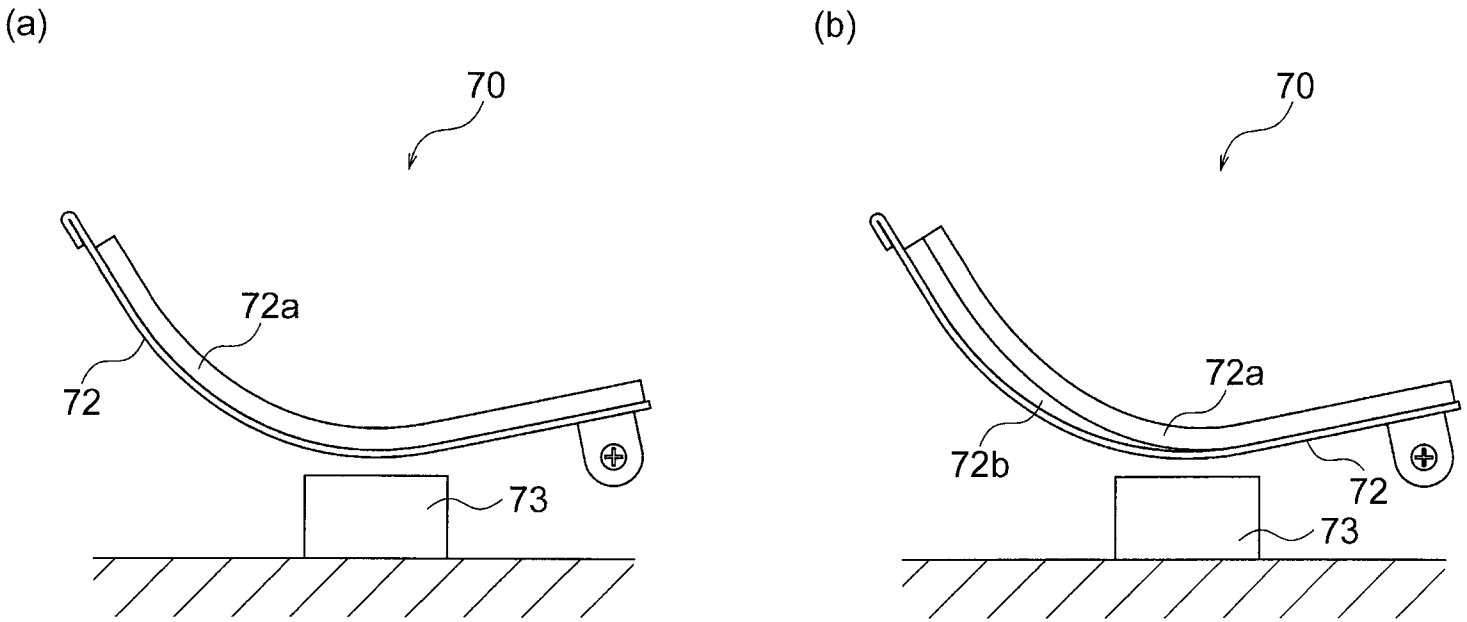
FIG. 16 (*a*) is a side view showing a configuration of a coin-roll accommodating portion of the ejecting unit according to the present embodiment, and FIG. 16(*b*) is a side view showing a coin-roll accommodating portion of the ejecting unit according to the modified example.

In the above description, the ejecting unit 70 has been described in such a manner that the shock absorbing rubber plate 72*a* is provided at the bottom of the coin-roll accommodating section 72 as shown in FIG. 16 (*a*). However, the coin-roll handling device according to the present invention is not limited to such an aspect. For example, as shown in FIG. 16 (*b*), the shock absorbing rubber plate 72*a* may be provided at the bottom of the coin-roll accommodating section 72 and a sponge 72*b* may be further provided under the shock absorbing rubber plate 72*a*. In this case, when the roll of coins diverted from the transporting unit 40 by the diverting lever 78 is sent to the ejecting unit 70 via the opening 2*a*, and this roll of coins is accommodated in the coin-roll accommodating section 72 of this ejecting unit 70, it is possible to suppress the rebound of the roll of coins, and the impact sound when the roll of coins falling from the opening 2*a* collides with the coin-roll accommodating section 72 can also be absorbed by the sponge 72*b*. Specifically, in the coin-roll accommodating section 72 configured as shown in FIG. 16 (*a*), the magnitude of the impact sound when the roll of coins falling from the opening 2*a* collides with the coin-roll accommodating section 72 is, for example, 80 dB. On the other hand, in the coin-roll accommodating section 72 configured as shown in FIG. 16 (*b*), the magnitude of the impact sound when the roll of coins falling from the opening 2*a* collides with the coin-roll accommodating section 72 can be reduced to, for example, 75 dB. In FIGS. 16 (*a*) and 16 (*b*), a rubber member 73 as a stopper is provided below the coin-roll accommodating section 72, and it is possible to alleviate the shock by this rubber member 73 when the coin-roll accommodating section 72 is pushed down at the moment when the roll of coins falls into the coin-roll accommodating section 72 and collides with it.

Figure 17:
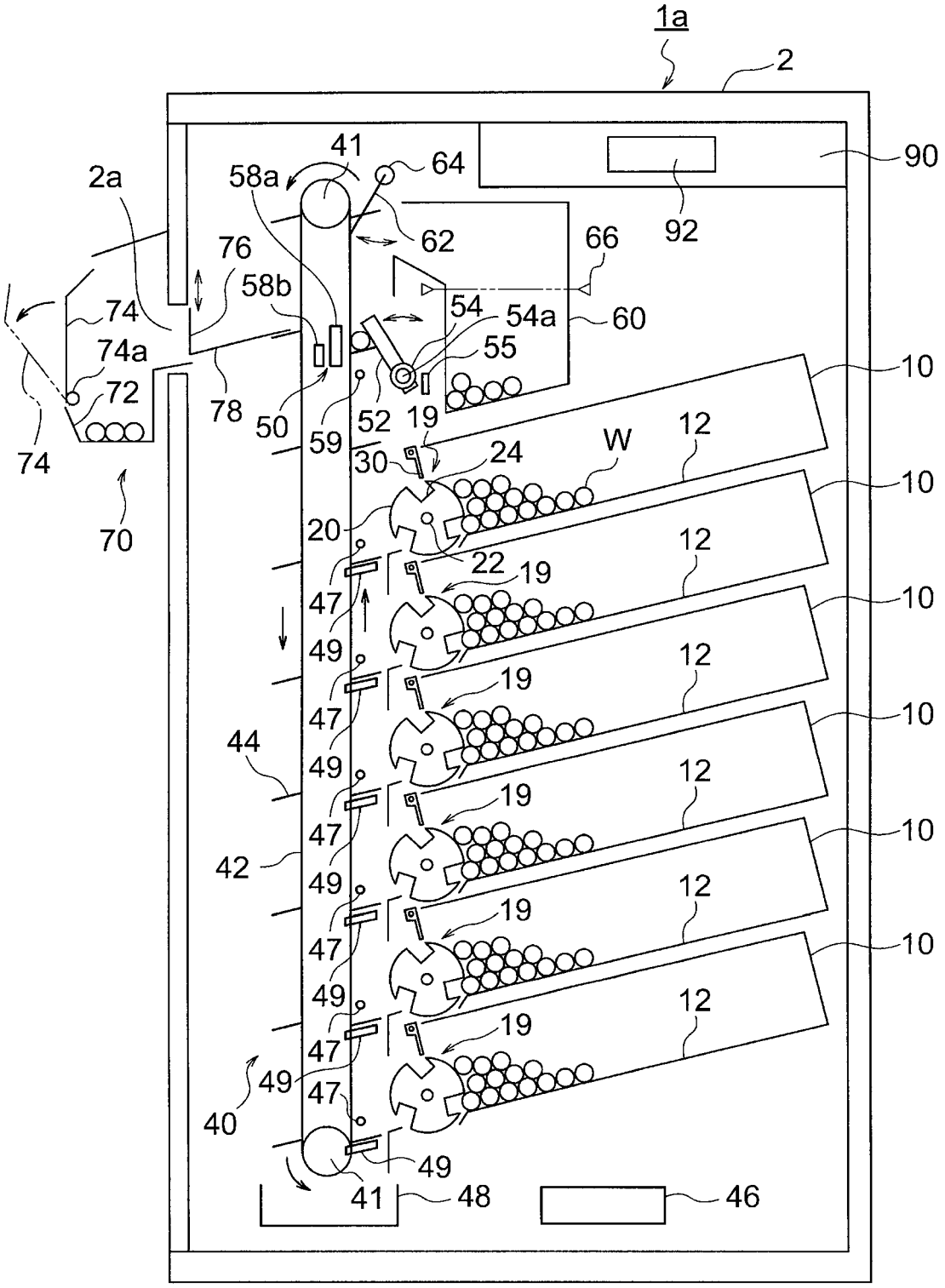
FIG. 17 is a side view schematically showing an internal configuration of a coin-roll handling device according to a modified example.
Figure 18:
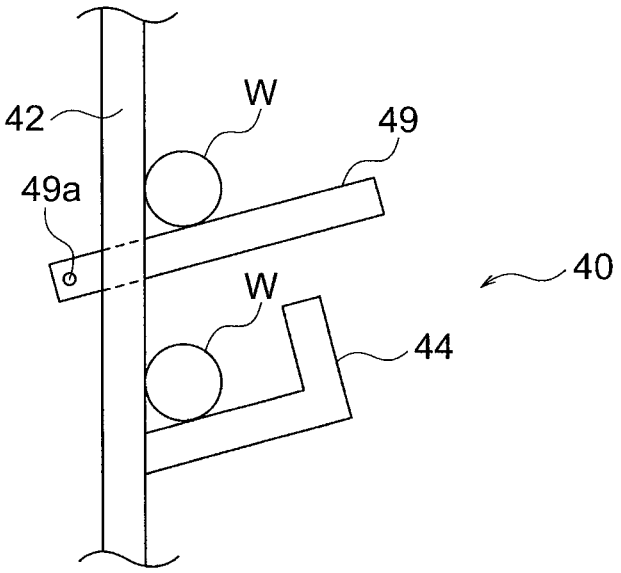
FIG. 18 is a side view showing a configuration of a fall prevention lever and the protruding members of the endless belts provided in the coin-roll handling device shown in FIG. 17.

Further, in a coin-roll handling device 1*a* having another configuration as shown in FIG. 17, a plurality of fall prevention levers 49 may be provided in the vicinity of the endless belt 42 of the transporting unit 40 corresponding to each storage unit 10. The configuration of such a fall prevention lever 49 will be described with reference to FIGS. 18 to 20. As shown in FIG. 18 and the like, each fall prevention lever 49 is rotatable around a shaft 49*a* provided at a proximal end portion on the side of the endless belt 42. Since a plurality of such fall prevention levers 49 is provided, one for each storage unit 10, when the roll of coins are fed out from each storage unit 10 by the rotatable member 20 and hooked on the protruding members 44 provided on each endless belt 42 of the transporting unit 40, even if the roll of coins falls, it is possible to catch such falling roll of coins with the fall prevention lever 49.

Figure 19:
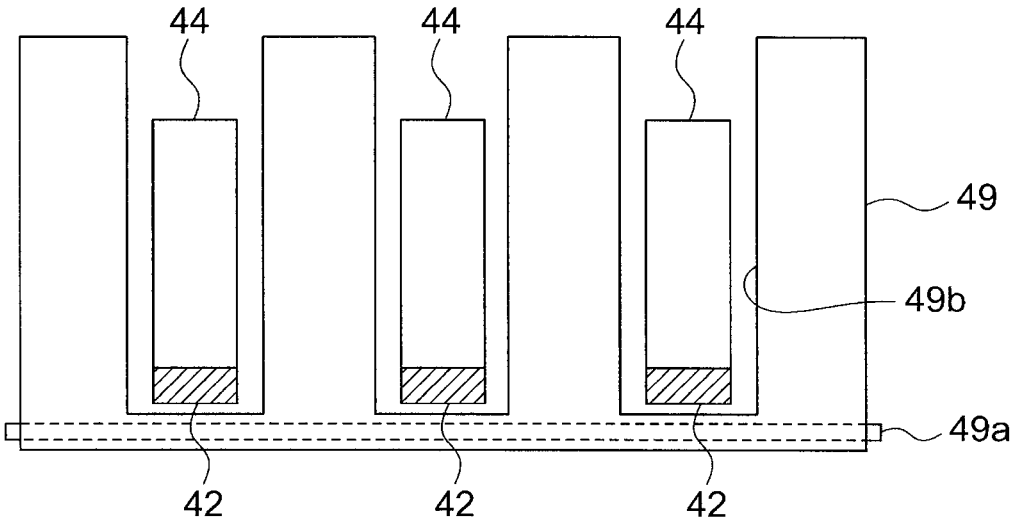
FIG. 19 is a top view showing a configuration when the fall prevention lever and the endless belts in FIG. 18 are viewed from above.

In the coin-roll handling device 1*a* according to the modified example, as shown in FIG. 18, each of the plurality of protruding members 44 provided on each endless belt 42 of the transporting unit 40 and on which the roll of coins is hooked has an L shape so that the tip portion thereof is bent upward. FIG. 19 is a view showing the configuration when the protruding members 44 provided on each endless belt 42 of the transporting unit 40 and the fall prevention lever 49 are viewed from above. The upper side in FIG. 19 is the side on which the rotatable member 20 of each storage unit 10 is provided. As shown in FIG. 19, in the fall prevention lever 49, a groove 49*b* through which each endless belt 42 and each protruding member 44 provided on each endless belt 42 passes is formed.

Further, a torsion spring and a stopper (not shown) are provided on the shaft 49*a* of each fall prevention lever 49, and by means of the torsion spring, each fall prevention lever 49 is biased by a force to rotate in the clockwise direction in FIGS. 17 and 18 about the shaft 49*a*. When no force is externally applied to each fall prevention lever 49, each fall prevention lever 49 is maintained in a position as shown in FIGS. 17 and 18 by the stopper (not shown). On the other hand, when the fall prevention lever 49 is pushed upward by the roll of coins hooked on the protruding members 44 provided on each endless belt 42, the fall prevention lever 49 rotates about the shaft 49*a* in the counterclockwise direction in FIGS. 17 and 18 against the urging force by the torsion spring. Thereafter, when each protruding member 44 passes upward through the fall prevention lever 49 and the fall prevention lever 49 is not pushed upward by the roll of coins, the fall prevention lever 49 returns to the position as shown in FIGS. 17 and 18 by the torsion spring and the stopper provided on the shaft 49*a*.

Figure 20:
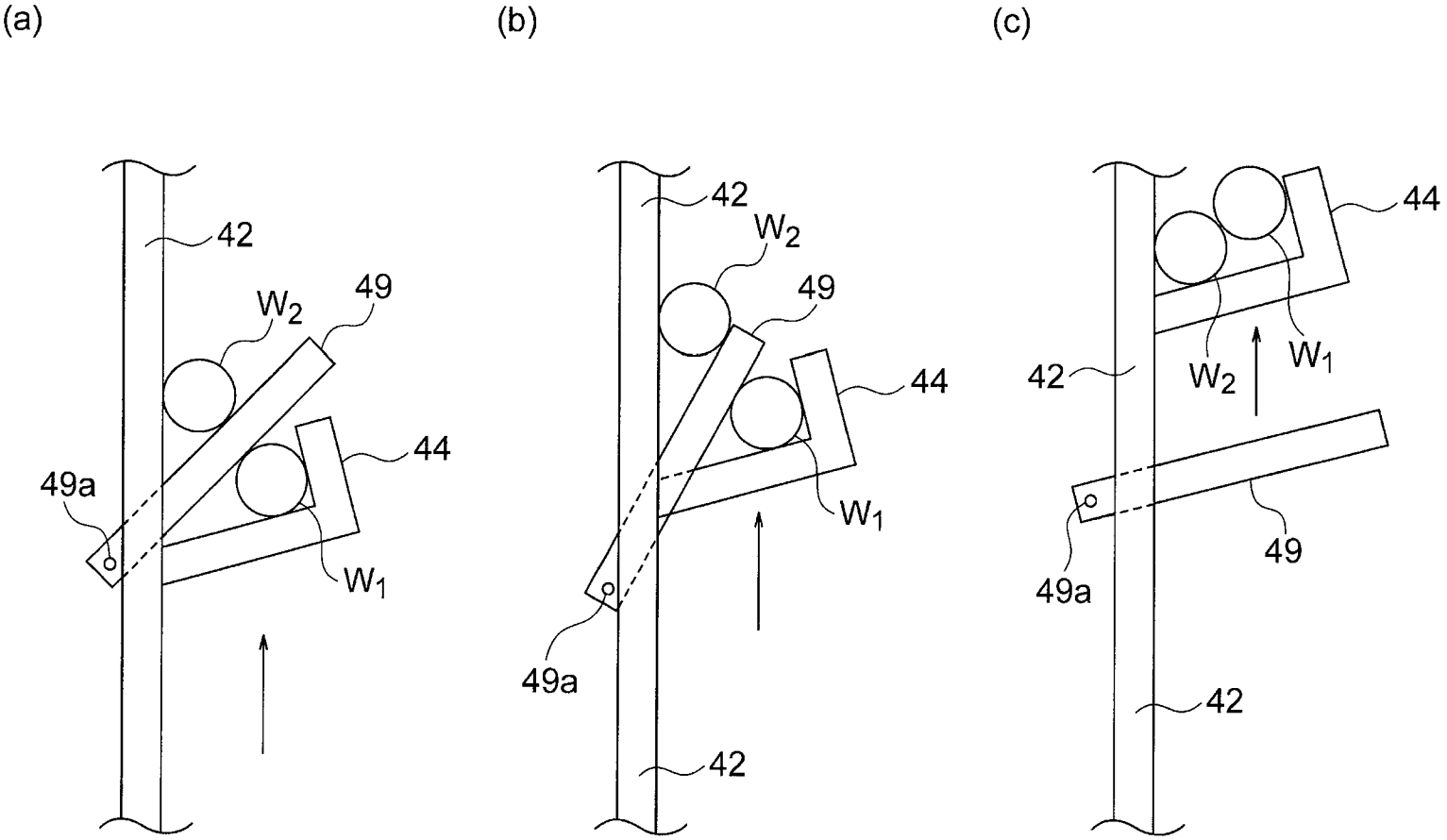
FIGS. 20 (*a*) to 20 (*c*) are side views sequentially showing the operation when the roll of coins on the fall prevention lever is transferred to the protruding members of the endless belts.

According to the coin-roll handling device 1*a* provided with such a fall prevention lever 49, as described above, when the roll of coins is fed out from each storage unit 10 by the rotatable member 20 and hooked on the protruding members 44 provided on each endless belt 42 of the transporting unit 40, even if the roll of coins falls, it is possible to receive such falling roll of coins by the fall prevention lever 49. The roll of coins received by the fall prevention lever 49 is indicated by reference symbol $W_2$ in FIG. 20. Thereafter, as the next protruding member 44 approaches the fall prevention lever 49, the protruding member 44 itself can move upwards from this fall prevention lever 49 through each groove 49*b* of the fall prevention lever 49. If the next protruding members 44 is hooking the roll of coins (the roll of coins hooked on such next protruding members 44 is indicated by reference symbol $W_1$ in FIG. 20), the fall prevention lever 49 is pushed upward by the roll of coins hooked on the protruding members 44 as shown in FIG. 20 (*a*)(*b*). Then, the fall prevention lever 49 is pushed upward against the urging force of the torsion spring and rotated about the shaft 49*a* in the counterclockwise direction in FIG. 20. Thereafter, as shown in FIG. 20 (*c*), the roll of coins received by the fall prevention lever 49 is transferred to the protruding members 44, and the protruding members 44 transport two rolls of coins. Further, when the protruding members 44 pass upward from the fall prevention lever 49 and the fall prevention lever 49 is not pushed upward by the roll of coins, the fall prevention lever 49 is returned to its original position as shown in FIG. 20 (*c*) by the torsion spring and the stopper provided on the shaft 49*a*. Then, when two rolls of coins are transported upward, it is determined that the denomination is abnormal based on the first characteristic value or the second characteristic value detected by the coin-roll characteristic-value detecting unit 50, and two rolls of coins are diverted to the rejecting unit 60 by the diverting lever 62. In the example of FIG. 20, the case where the protruding members 44 transport two rolls of coins has been described. However, even when the protruding members 44 that transport no roll of coins pass through the fall prevention lever 49, the protruding members 44 receive the roll of coins on the fall prevention lever 49 in the same way and transport one roll of coins. Therefore, the roll of coins is handled in the same way as when the protruding members 44 normally receive the roll of coins from the rotatable member 20. Further, in the absence of the roll of coins on the fall prevention lever 49, when the protruding members 44 normally transport the roll of coins, the fall prevention lever 49 is pushed up by the roll of coins and then the roll of coins is transported, and the fall prevention lever 49 returns to the original position after the roll of coins has passed. As described above, in the coin-roll handling device 1*a* according to the modified example, even if the roll of coins falls on the fall prevention lever 49, it is possible to automatically deliver the roll of coins from the fall prevention lever 49 to the protruding members 44, and then it is possible to continue the dispensing process of the roll of coins without interruption. In this way, when the roll of coins is fed out from each storage unit 10 by the rotatable member 20 and hooked on the protruding members 44 provided on the endless belt 42 of the transporting unit 40, it is possible to reduce the pause rate of the coin-roll handling device 1*a* due to falling of the roll of coins.

The invention claimed is:

1. A coin-roll handling device comprising:

a housing;

a storage unit capable of storing a plurality of rolls of coins and provided with an ejecting mechanism for ejecting a stored roll of coins;

a transporting unit having a transport path configured to transport the roll of coins ejected from the storage unit by the ejecting mechanism;

a coin-roll characteristic-value detecting unit configured to detect at least one of a first characteristic value relating to a diameter of the roll of coins being transported by the transporting unit and a second characteristic value relating to a kind of the material of the roll of coins being transported by the transporting unit, provided downstream of the storage unit in a transportation direction of the roll of coins by the transporting unit;

a denomination determining unit configured to determine a denomination of the roll of coins based on at least one of the first characteristic value relating to the diameter of the roll of coins and the second characteristic value relating to the kind of the material of the roll of coins detected by the coin-roll characteristic-value detecting unit;

an ejecting unit configured to eject the roll of coins transported by the transporting unit from inside to outside of the housing;

a rejecting unit that stores therein the rolls of coins that should not be ejected out of the housing; and a control unit configured to control at least the ejecting mechanism of the storage unit, the coin-roll characteristic-value detecting unit, the denomination determining unit and the transporting unit, wherein the coin-roll characteristic-value detecting unit includes a first characteristic-value detecting portion having a rotatable detecting lever on one side of the transport path to contact the roll of coins to identify the first characteristic value relating to the diameter of the roll of coins being transported by the transporting unit and a second characteristic-value detecting portion having a circuit and a sensor on another side of the transport path, such that the circuit emits a magnetic field and the sensor detects a change in the magnetic field caused by the roll of coins passing near the magnetic field to identify the second characteristic value relating to the kind of the material of the roll of coins being transported by the transporting unit;

the denomination determining unit determines the denomination of the roll of coins based on both the first characteristic value relating to the diameter of the roll of coins detected by the first characteristic-value detecting portion and the second characteristic value relating to the kind of the material of the roll of coins detected by the second characteristic-value detecting portion;

the first characteristic-value detecting portion and the second characteristic-value detecting portion are arranged so as to sandwich the transport path of the roll of coins; and the control unit controls the components of the coin-roll handling device, such that firstly the ejecting mechanism ejects the roll of coins from the storage unit, secondly the transport unit transports the ejected roll of coins, thirdly the coin-roll characteristic-value detecting unit detects the first characteristic value and the second characteristic value of the roll of coins being transported by the transport unit, and thereafter the transport unit transports the roll of coins to the ejecting unit or to the rejecting unit based on a detection result of the coin-roll characteristic-value detecting unit.

2. The coin-roll handling device as claimed in claim 1, further comprising:

a diverting unit configured to divert the roll of coins being transported by the transporting unit to either the ejecting unit or the rejecting unit, wherein the roll of coins is diverted to the ejecting unit from the transporting unit by the diverting unit if the denomination of the roll of coins is determined by the denomination determining unit as the denomination of the roll of coins to be ejected from the inside to the outside of the housing, and the roll of coins is diverted to the rejecting unit from the transporting unit by the diverting unit if the denomination of the roll of coins is determined by the denomination determining unit as not being the denomination of the roll of coins to be ejected from inside to outside of housing.

3. The coin-roll handling device as claimed in claim 1, wherein the first characteristic-value detecting portion includes a detecting lever that is capable of contacting the roll of coins being transported by the transporting unit and is rotatable about a shaft, a magnet that rotates integrally with the detecting lever, and an angle sensor that detects a rotational angle of the detecting lever when the roll of coins being transported by the transporting unit comes in contact with the detecting lever, the angle sensor detecting the rotational angle of the detecting lever based on the change of the magnetic field caused by the rotation of the magnet, and the first characteristic-value detecting portion detects the first characteristic value relating to the diameter of the roll of coins being transported by the transporting unit based on the rotational angle of the detecting lever.

4. The coin-roll handling device as claimed in claim 3, wherein the coin-roll characteristic-value detecting unit further includes a temperature sensor, and the first characteristic-value detecting portion detects the first characteristic value relating to the diameter of the roll of coins being transported by the transporting unit based on a corrected value that is obtained by correcting the rotational angle of the detecting lever detected by the angle sensor based on a temperature detected by the temperature sensor.

5. The coin-roll handling device as claimed in claim 3, wherein at least a part of the detecting lever is formed of resin.

6. The coin-roll handling device as claimed in claim 3, wherein the transporting unit includes a linearly extending transporting member and the roll of coins is transported along a direction in which the transporting member extends, and the first characteristic-value detecting portion is disposed in a region on the same side as the roll of coins being transported by the transporting unit with respect to the transporting member.

7. The coin-roll handling device as claimed in claim 1, wherein the second characteristic-value detecting portion includes a circuit including at least a coil and a capacitor and a sensor for detecting an impedance characteristic and an inductance characteristic of the circuit, and a magnetic field is generated in the vicinity of the circuit by an alternating current flowing through the coil of the circuit, the second characteristic-value detecting portion detects the second characteristic value based on an amount of changes in the impedance characteristic and the inductance characteristic of the circuit when the roll of coins being transported by the transporting unit passes through the vicinity of the circuit.

8. The coin-roll handling device as claimed in claim 7, wherein the transporting unit includes a linearly extending transporting member and the roll of coins is transported along a direction in which the transporting member extends, and the circuit is disposed in a region closer to the transporting member than an area in which the roll of coins is transported by the transporting unit.

9. The coin-roll handling device as claimed in claim 8, wherein the coin-roll characteristic-value detecting unit further includes a temperature sensor, and the second characteristic-value detecting portion detects the second characteristic value relating to the kind of the material of the roll of coins being transported by the transporting unit based on a corrected value that is obtained by correcting the amount of changes in the impedance characteristic and the inductance characteristic of the circuit based on a temperature detected by the temperature sensor.

10. The coin-roll handling device as claimed in claim 1, wherein the transporting unit includes a plurality of endless belts arranged in parallel and each of which has a plurality of protruding members on which the roll of coins is hooked, and in each of the endless belts, each of the protruding members is formed to project out such that a surface of the protruding member contacting the roll of coins extends in a direction inclined with respect to a direction in which the endless belt extends, the roll of coins hooked on the protruding member is shifted toward the endless belt on the protruding member by a weight of the roll of coins.

11. The coin-roll handling device as claimed in claim 10, wherein, in each of the endless belts, the protruding members of the endless belts are arranged in a same phase in a movement direction of the endless belt.

12. The coin-roll handling device as claimed in claim 10, further comprising a coin-roll detecting sensor for detecting the roll of coins ejected from the storage unit by the ejecting mechanism, wherein the coin-roll detecting sensor is also capable of detecting each of the protruding members of the transporting unit.

13. The coin-roll handling device as claimed in claim 2, wherein a first shutter capable of being opened and closed is provided between the transporting unit and the ejecting unit, and the roll of coins is sent from the transporting unit to the ejecting unit by opening the first shutter.

14. The coin-roll handling device as claimed in claim 2, wherein the rejecting unit is provided with a full-state detection sensor that detects when the rejecting unit is full with or almost full with the roll of coins.

15. The coin-roll handling device as claimed in claim 2, wherein the ejecting unit is provided with a second shutter that selectively enables access to the roll of coins sent from the transporting unit to the ejecting unit, and when the second shutter is opened, it becomes possible to access the roll of coins in the ejecting unit from the outside of the housing.

16. The coin-roll handling device as claimed in claim 1, wherein a coin receiving unit that receives a coin dropped from the transporting unit by a weight of the coin is provided below the transporting unit.

17. A coin-roll handling device comprising:

a storage unit capable of storing a plurality of rolls of coins and provided with an ejecting mechanism for ejecting a stored roll of coins;

a transporting unit configured to transport the roll of coins ejected from the storage unit by the ejecting mechanism;

a coin-roll characteristic-value detecting unit configured to detect at least one of a first characteristic value relating to a diameter of the roll of coins being transported by the transporting unit and a second characteristic value relating to a kind of the material of the roll of coins being transported by the transporting unit, provided downstream of the storage unit in a transportation direction of the roll of coins by the transporting unit;

a denomination determining unit configured to determine a denomination of the roll of coins based on at least one of the first characteristic value relating to the diameter of the roll of coins and the second characteristic value relating to the kind of the material of the roll of coins detected by the coin-roll characteristic-value detecting unit; and a plurality of coin-roll detecting sensors for detecting the roll of coins ejected from the storage unit by the ejecting mechanism, wherein the transport unit includes an endless belt provided with a plurality of protruding members for transporting the roll of coins; and one of the coin-roll detecting sensors being located in each dispensing region in which the protruding members of the endless belt shift, each coin-roll detecting sensor being capable of detecting both the protruding members of the transporting unit and the roll of coins fed out from the storage unit.

18. A coin-roll handling device comprising:

a housing;

a storage unit capable of storing a plurality of rolls of coins and provided with an ejecting mechanism for ejecting a stored roll of coins;

a transporting unit configured to transport the roll of coins ejected from the storage unit by the ejecting mechanism;

a coin-roll characteristic-value detecting unit configured to detect at least one of a first characteristic value relating to a diameter of the roll of coins being transported by the transporting unit and a second characteristic value relating to a kind of the material of the roll of coins being transported by the transporting unit, provided downstream of the storage unit in a transportation direction of the roll of coins by the transporting unit;

a denomination determining unit configured to determine a denomination of the roll of coins based on at least one of the first characteristic value relating to the diameter of the roll of coins and the second characteristic value relating to the kind of the material of the roll of coins detected by the coin-roll characteristic-value detecting unit;

an ejecting unit configured to eject the roll of coins transported by the transporting unit from inside to outside of the housing;

a rejecting unit that stores therein the rolls of coins that should not be ejected out of the housing, the rejecting unit including a full-state detection sensor that detects when the rejecting unit is full with or almost full with the roll of coins; and a diverting lever provided near the rejecting unit, the diverting lever being rotatable about a shaft between an advanced position at which the diverting lever contacts the roll of coins transported by the transporting unit and a retracted position at which the diverting lever does not contact the roll of coins transported by the transporting unit; wherein the coin-roll characteristic-value detecting unit includes a first characteristic-value detecting portion that detects the first characteristic value relating to the diameter of the roll of coins being transported by the transporting unit and a second characteristic-value detecting portion that detects the second characteristic value relating to the kind of the material of the roll of coins being transported by the transporting unit;

the denomination determining unit determines the denomination of the roll of coins based on both the first characteristic value relating to the diameter of the roll of coins detected by the first characteristic-value detecting portion and the second characteristic value relating to the kind of the material of the roll of coins detected by the second characteristic-value detecting portion;

the first characteristic-value detecting portion and the second characteristic-value detecting portion are arranged so as to sandwich a transport path of the roll of coins;

a control unit controls the components of the coin-roll handling device such that firstly the ejecting mechanism ejects the roll of coins from the storage unit, secondly the transport unit transports the ejected roll of coins, thirdly the coin-roll characteristic-value detecting unit detects the first characteristic value and the second characteristic value of the roll of coins being transported by the transport unit, and thereafter the transport unit transports the roll of coins to the ejecting unit or the rejecting unit based on detection result of the coin-roll characteristic-value detecting unit;

the rejecting unit is provided on the downstream of the coin-roll characteristic-value detecting unit and upstream of the ejecting unit, and the roll of coins being transported by the transporting unit is diverted from the transporting unit to the rejecting unit by rotating the diverting lever from the retracted position to the advanced position.

19. A coin-roll handling device according to claim 18, wherein the transporting unit extends along a vertical direction, the rejecting unit is arranged downstream of the coin-roll characteristic-value detecting unit and upstream of the ejecting unit, and the rejecting unit is positioned above the storage unit.

20. A coin-roll handling device according to claim 18, wherein the transporting unit extends along a vertical direction, the diverting lever diverts the roll of coins when the roll of coins is transported upward.

* * * * *